US006394842B1

(12) United States Patent
Sakurai et al.

(10) Patent No.: US 6,394,842 B1
(45) Date of Patent: May 28, 2002

(54) CABLE CONNECTING STRUCTURE

(75) Inventors: Atsushi Sakurai; Takeshi Okuyama; Manabu Shimizu; Hideo Miyazawa, all of Tokyo (JP)

(73) Assignee: Fujitsu Takamisawa Component Limited, Tokyo (JP)

( * ) Notice: Subject to any disclaimer, the term of this patent is extended or adjusted under 35 U.S.C. 154(b) by 0 days.

(21) Appl. No.: 09/442,096

(22) Filed: Nov. 17, 1999

(30) Foreign Application Priority Data

Apr. 1, 1999 (JP) ..... 11-095023
Jul. 5, 1999 (JP) ..... 11-191028

(51) Int. Cl.[7] ..... H01R 13/648
(52) U.S. Cl. ..... 439/607; 439/352
(58) Field of Search ..... 439/350–372, 439/607–610

(56) References Cited

U.S. PATENT DOCUMENTS 5,397,246 A * 3/1995 Defibaugh et al. ..... 439/352
5,460,533 A * 10/1995 Broeksteeg et al. ..... 439/101
5,951,316 A * 9/1999 Kawano et al. ..... 439/352
6,093,057 A * 7/2000 Lok ..... 439/607

* cited by examiner

*Primary Examiner*—Khiem Nguyen
(74) *Attorney, Agent, or Firm*—Staas & Halsey LLP

(57) ABSTRACT

A cable connecting structure includes a shroud adapted to be mounted on a panel carrying pins, the shroud having a shroud body enclosing the pins when the shroud is mounted on the panel and including a plurality of compartments, and a shielding member provided on the shroud body so as to cover an inner wall of the shroud body. The shielding members provide electromagnetic shielding so as to improve the electromagnetic compatibility of the connecting structure.

7 Claims, 31 Drawing Sheets

100
104
108
58,59
102
106
57c1
104a
57
56c1
104b
56
40
108a
107
108b
102a
54
53
41b1
41a1
41
X1
X2
Y1
Y2

CABLE CONNECTING STRUCTURE

BACKGROUND OF THE INVENTION

1. Field of the Invention

The present invention relates generally to a cable connecting structure, and more particularly, to a cable connecting structure having improved electromagnetic compatibility.

2. Description of the Related Art

In recent years, it has come to be expected that communications equipment be able to transmit large volumes of data with a high degree of reliability. In order to do so it is necessary to transmit data at speeds as high as, for example, 1 Gigabit per second.

With respect to the connector apparatus, however, as the speed of data transmission increases so, too, does the amount of electromagnetic interference emitted from the connector connecting part as does the degree of susceptibility to external electromagnetic radiation. As a result, a connector apparatus having improved electromagnetic compatibility is sought.

Electromagnetic compatibility means the ability of a communications apparatus to operate normally under a variety of electromagnetic environmental conditions. It is a concept that encompasses electromagnetic interference (EMI), electromagnetic susceptibility (EMS) and electrostatic discharge (ED).

FIG. 1 shows a conventional connector apparatus 10. Reference numeral 11 represents the interior of the communications apparatus. Reference numeral 12 represents the back panel of the communications apparatus. A plug 14 having long pins 13 is mounted on a front surface of the back panel 12. The pins 13 penetrate through-holes 12*a* formed in the back panel 12 and project beyond a back surface side of the back panel. Inside the communications apparatus a jack 15 is connected to the plug 14.

The connector apparatus 10 consists of a plastic shroud 16 and a cable connector 18 for a tip of a cable 17. Through-holes 16*a*1 in a floor surface 16*a* of the shroud engage the pins 13 projecting from the back surface side of the back panel 12, fixedly mounting the connector apparatus 10 to the back panel 12. The pins 13 project into the interior of the shroud 16. The cable connector 18 is inserted into the interior of the shroud 16 and is engaged thereat, being connected to the pins 13.

However, in the conventional connector apparatus 10, the shroud 16 is made of plastic, with no special measures taken to counter the effects of electromagnetic radiation.

SUMMARY OF THE INVENTION

Accordingly, it is the object of the present invention to provide an improved and useful cable connecting structure in which the problem described above is solved.

The above-described object of the present invention is achieved by a shroud adapted to be mounted on a panel carrying pins, comprising:

- a shroud body enclosing the pins when the shroud is mounted on the panel, the shroud body including a plurality of compartments; and
- a shielding member provided on the shroud body so as to cover an inner wall of the shroud body.

Additionally, the above-described object of the present invention is also achieved by a plug comprising:

- a housing made of electrically insulative material and including signal contacts;

- a metallic shield cover enclosing the housing;
- a latch member provided at both side surfaces of the housing; and
- a lock release member provided on an outer side of the shield cover, said lock release member comprising:
  - a pull tab on the same side from which a cable is extended; and
  - a projection disposed opposite the latch member, the projection releasing a locked state by using the latch member when the lock release member is pulled, the projection having a groove, the groove being guided by an edge of an opening of the shield cover.

According to the invention described above, the signal contacts are electromagnetically shielded by the shield cover. Additionally, when the lock release member is pulled any displacement of the projection toward the outside of the housing is restricted and, accordingly, the lock can be securely released.

Additionally, the above-described object of the present invention is also achieved by a connector assembly comprising:

- a shroud adapted to be mounted on a panel carrying pins, the shroud comprising:
- a shroud body enclosing the pins when the shroud is mounted on the panel, the shroud body including a plurality of compartments; and
- a shielding member provided on the shroud body so as to cover an inner wall of the shroud body; and
- a plug, the plug comprising:
  - a housing made of electrically insulative material and including signal contacts;
- a metallic shield cover enclosing the housing;
- a latch member provided at both side surfaces of the housing; and
- a lock release member provided on an outer side of the shield cover, the lock release member comprising:
  - a pull tab on a side from which a cable is extended; and
  - a projection disposed opposite the latch member, the projection releasing a lock of the latch member when the lock release member is pulled, the projection having a groove, the groove being guided to a portion facing an opening of the shield cover,
- the shield cover of the plug being electrically connected to the shielding member of the shroud, the plug being connected to one of the plurality of compartments of the shroud.

According to the invention described above, the shield plates assume a ground potential, thereby improving electromagnetic compatibility and making it possible to accommodate high-speed signal transmissions.

Additionally, the above-described object of the present invention is also achieved by a connector comprising:

- a shroud body including a plurality of compartments for connecting a plurality of plugs;
- a shielding member having a body and a plurality of leads provided on the shroud body so that the shroud body covers an inner wall of the shroud body and the leads project from a bottom surface of the shroud body; and
- a plurality of pins projecting through and fixed to a bottom surface of the shroud body, the plurality of pins projecting into an interior of the compartments and further projecting from the bottom surface of the shroud body.

According to the invention described above, the shield plate assumes a ground potential when mounted on the panel, thereby improving electromagnetic compatibility and making it possible to accommodate high-speed signal transmissions.

Additionally, the above-described object of the present invention is also achieved by a plug comprising:

a connector body on which a latch member is mounted and which includes a signal contact;

a lock release member disposed on an outer side of the connector body and having a projection opposite the latch member, the projection releasing a lock of the latch member when displaced in a predetermined direction relative to the connector body; and a spring generating a force to pull the connector body and the lock release member together.

According to the invention described above, it is possible to securely return the lock release member and the connector body to relative original positions because a force is generated between the lock release member and the connector body in a direction that brings the two together after the latch member lock has been released. Accordingly, the latch member can be securely locked each time a plug is connected, thereby achieving a highly reliable plug connection.

Other objects, features and advantages of the present invention will become more apparent from the following detailed description when read in conjunction with the accompanying drawings.

DESCRIPTION OF THE PREFERRED EMBODIMENTS

A description will now be given of embodiments of the present invention, with reference to the accompanying drawings.

Figure 1:
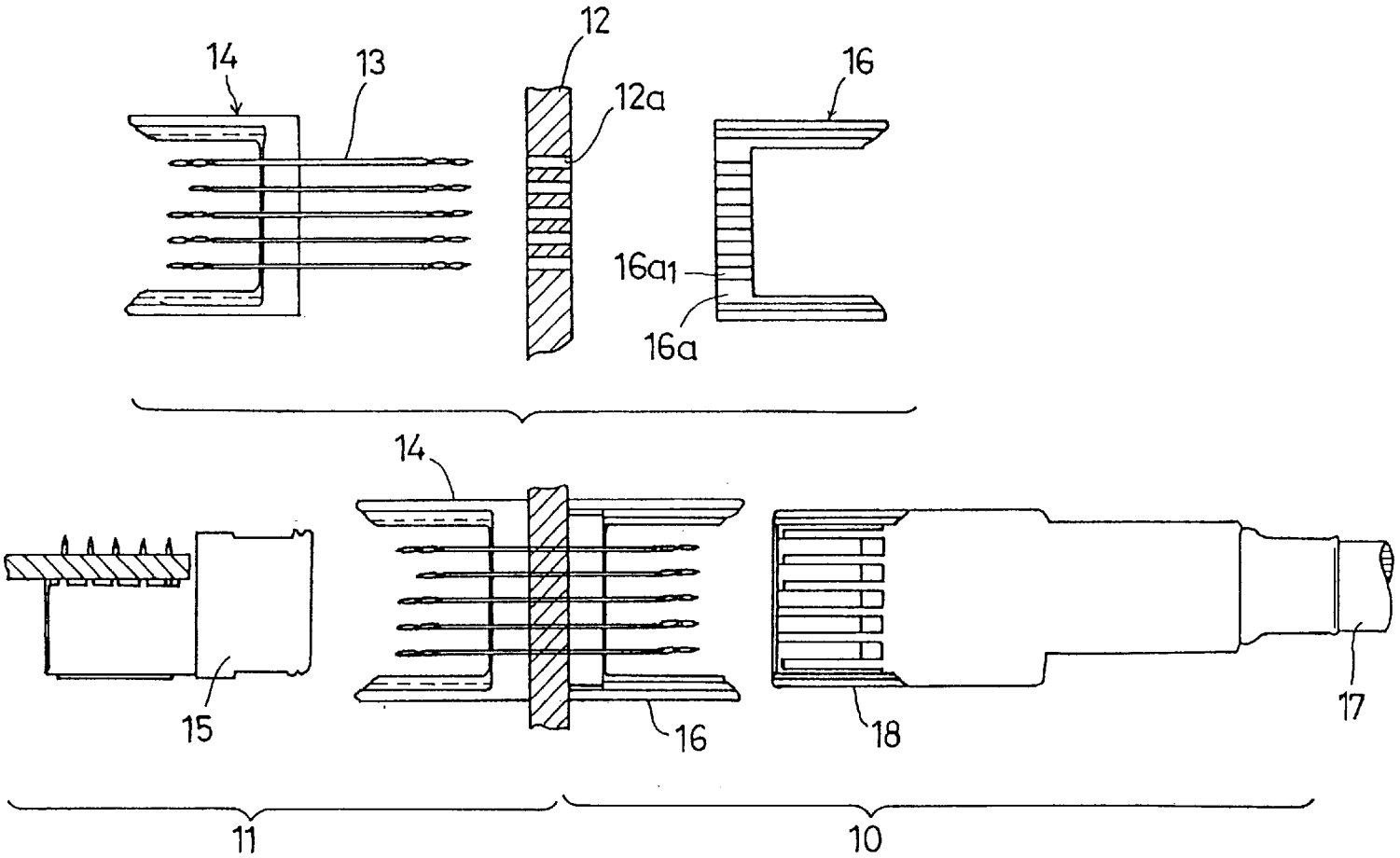
FIG. 1 PRIOR ART
FIG. 1 is a diagram showing a conventional connector apparatus.
Figure 2:
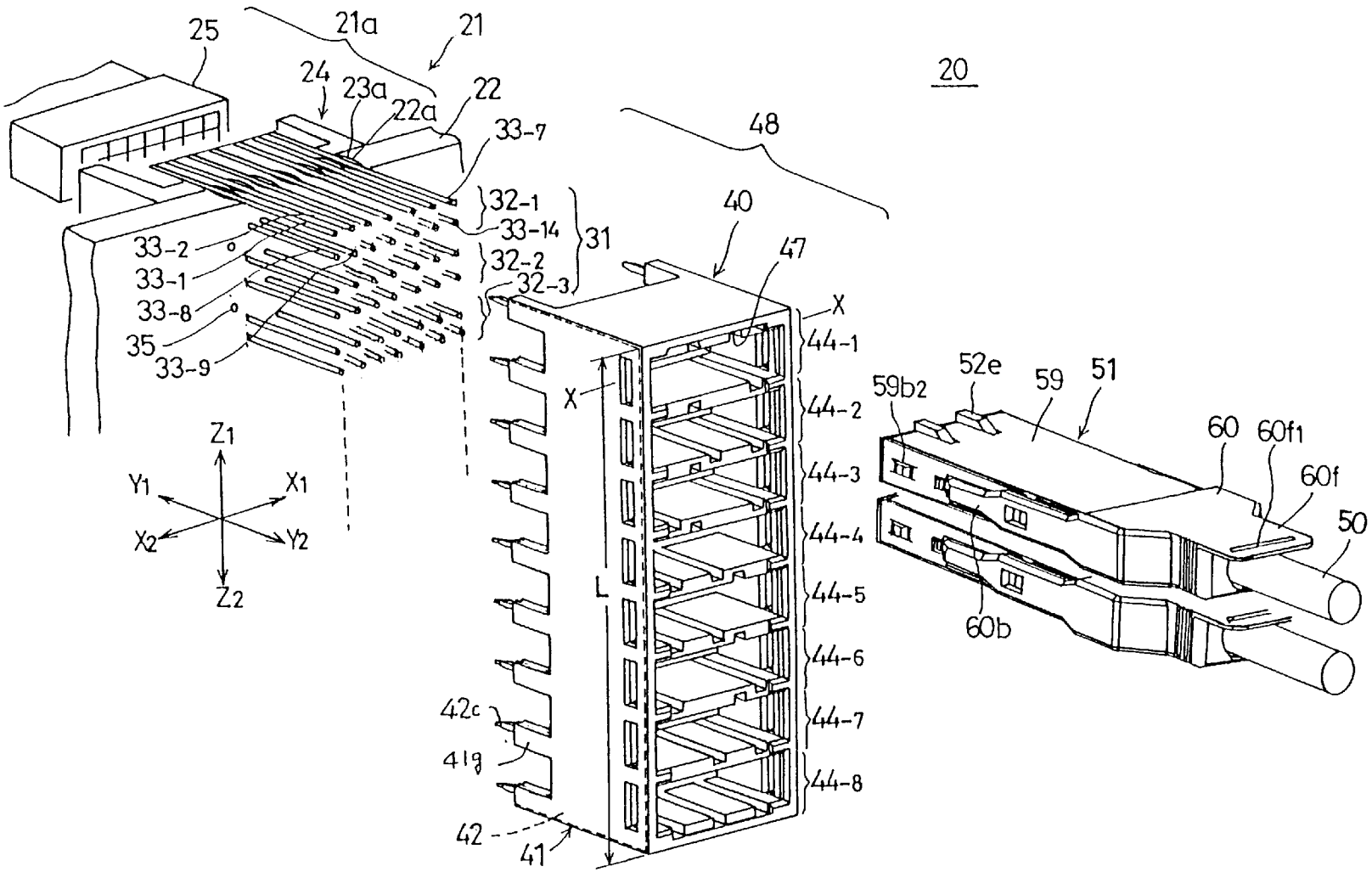
FIG. 2 is a diagram showing a connector apparatus according to a first embodiment of the present invention.
Figure 3:
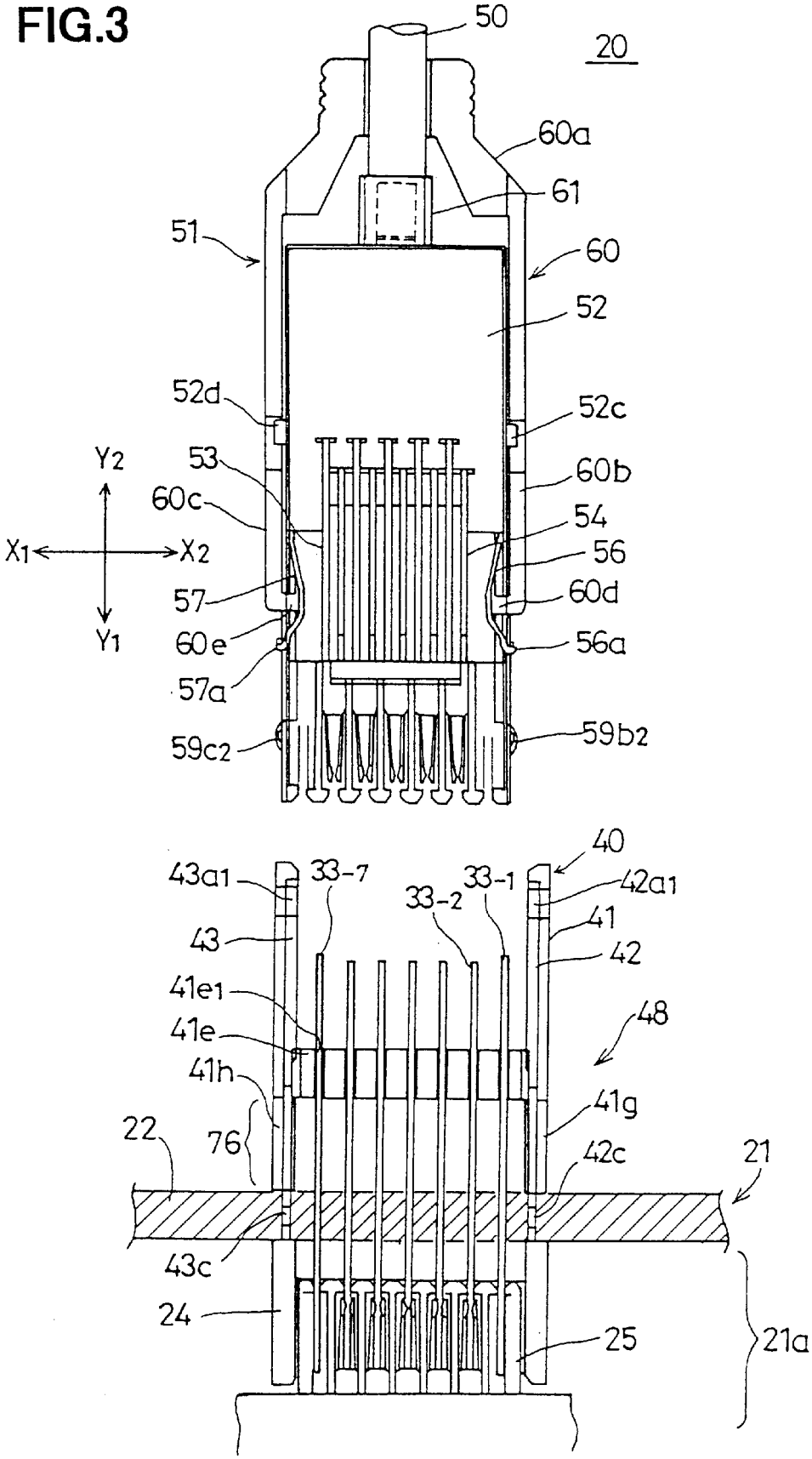
FIG. 3 is a diagram showing the connector apparatus of FIG. 2 in a state prior to connection.
Figure 4:
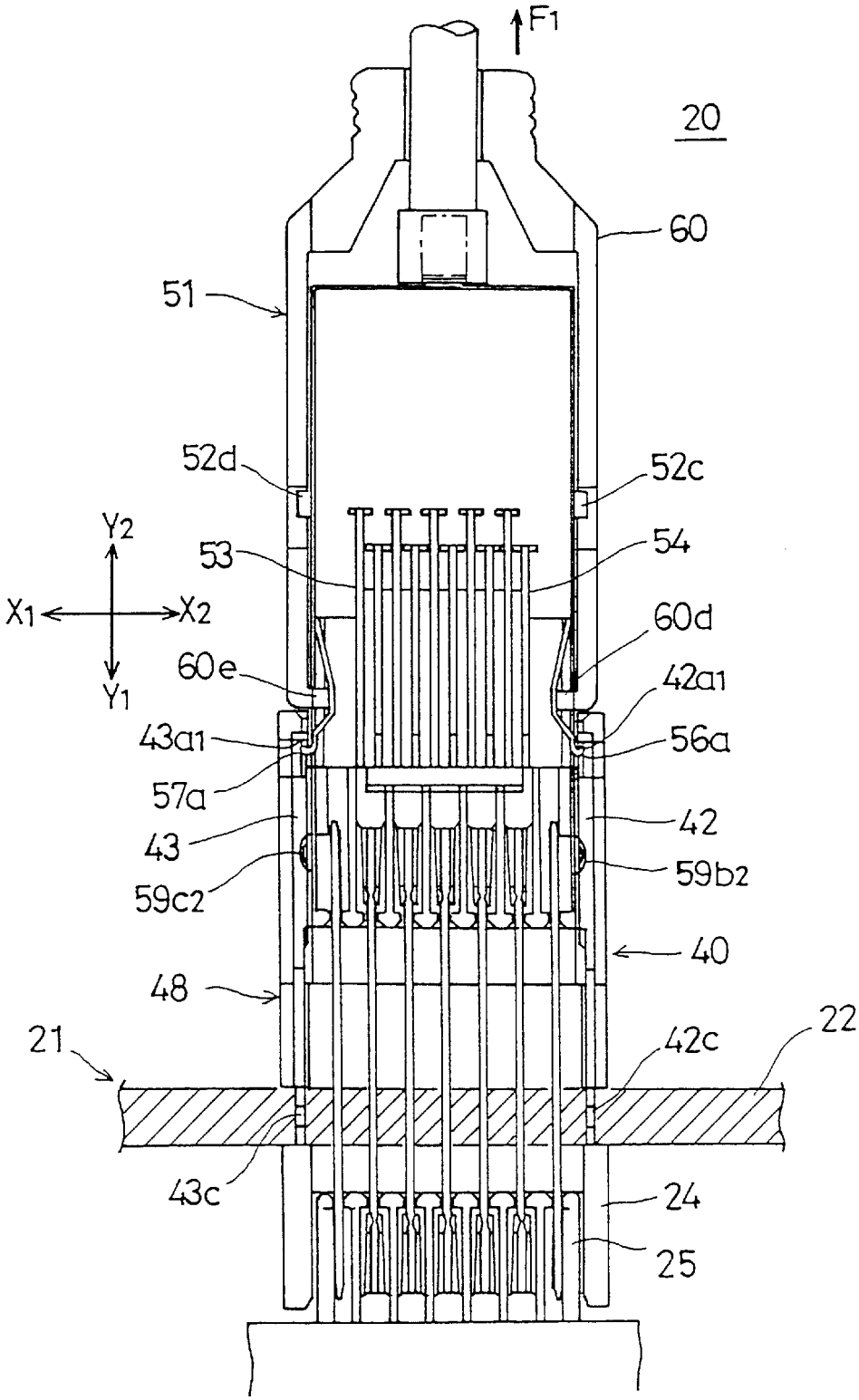
FIG. 4 is a diagram showing the connector apparatus of FIG. 2 in a state of connection.
Figure 5:
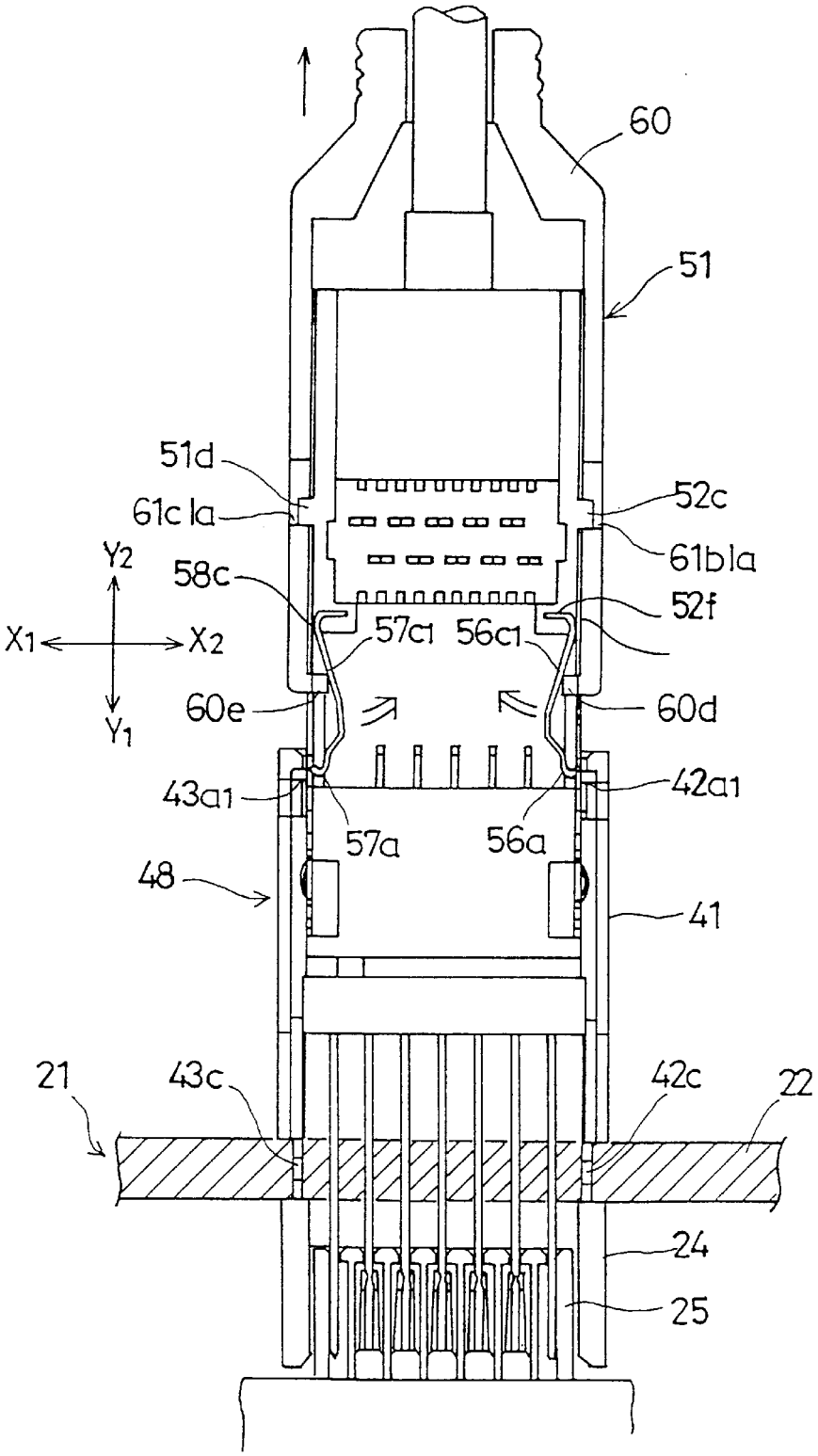
FIG. 5 is a diagram showing the connector apparatus of FIG. 2 in a state when released from connection.

FIG. 2 is an exploded view of a connector assembly according to a first embodiment of the present invention, FIG. 3 shows a state prior to connection and FIG. 4 shows a state after connection. FIG. 5 shows a state in which the connection has just been released. In the drawings, reference numeral 21 is a communications apparatus and 22 is a back panel of the communications apparatus. An interior 21*a* of the communications apparatus 21 is the same as the conventional art. A plug 24 having long pin terminals 23 is mounted on a front surface of the back panel 22, that is, a surface on an interior side of the communications apparatus 21, the pins 23 penetrating through-holes 22*a* formed in the back panel 22 and projecting into a rear side surface of the back panel 22. A jack 25 is connected to the plug 24 in the interior 21*a* of the communications apparatus 21.

In the communications apparatus 21 described above, differential data transfer is adopted. Differential data transfer involves balancing positive and negative signals to the same size with respect to a signal ground, and has the advantage of being more resistant to interference than the conventional non-differential method of transmission. When performing differential data transfer, it is necessary to separate the signal ground and the frame ground. The connector assembly 20 of the present embodiment is adaptable to separating the signal ground and the frame ground.

The connector assembly 20 comprises a group of pins 31 that project into a rear surface of the back panel 22, a shroud 40 and a plug 51 having a pull tab on an edge thereof and provided at the end of a cable 50. In broad outline, the connector assembly 20 is a structure in which a shroud 40 engages the pin group 31 and is fixedly mounted on the rear surface of the back panel 22, a plurality of plugs 51 engaging the shroud 40, the plurality of plugs 51 aligned in a closely spaced manner. In this specification, a plug means the connector provided at the end of a cable.

Figure 6:
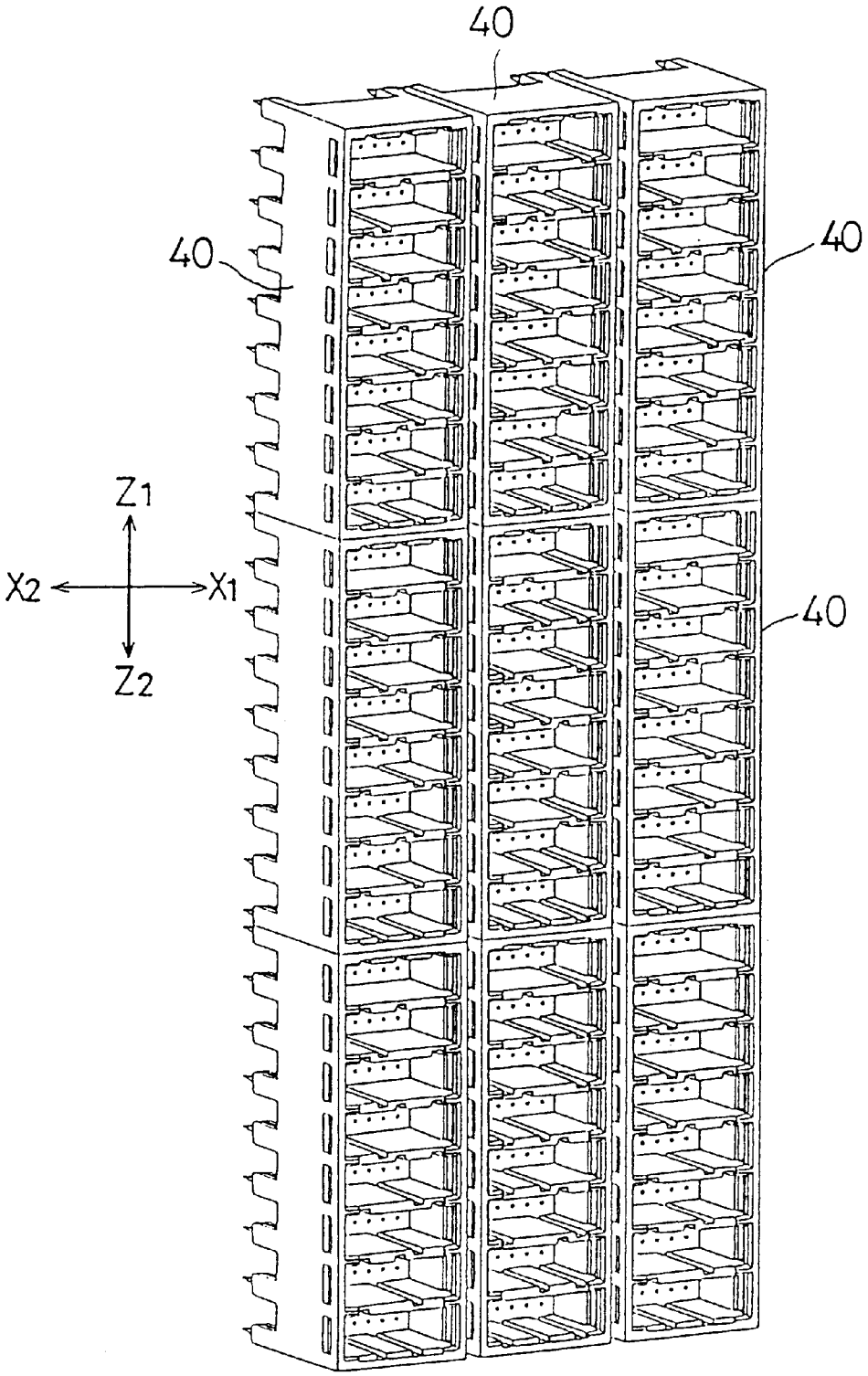
FIG. 6 is a diagram showing a disposition atop a back panel of a shroud.

In actuality, as shown in FIG. 6 a plurality of individual shrouds are closely spaced and fixedly mounted on the rear surface of the back panel 22. Hereinafter, for descriptive convenience a description will be given of a single shroud 40 or one part of a single shroud 40, as the case may be.

A description will now be given in the order of the pin group 31, the shroud 40 and the plug 51.

As shown in FIG. 2, the pin group 31 consists of a plurality of pin terminal sub-groups 32-1, 32-2, 32-3 and so forth, aligned in a vertical direction as indicated by the arrows Z1–Z2. The pin terminal sub-group 32-1, for example, comprises pins 33-1 through 33-14 aligned in two parallel rows of seven pins each in a lateral direction as indicated by the arrows X1–X2. Pins 33-1 through 33-14 comprise signal ground pins 33-1, 33-7, 33-8 and 33-14 at both ends in the X1-X2 direction and the remaining signal pins. The signal pins comprise positive signal pins 33-2 through 33-6 aligned laterally on the Z1 side and negative signal pins 33-9 through 33-13 aligned laterally on the Z2 side. Positive signal pin 33-2 and negative signal pin 33-9 are disposed opposite each other, and make up a pair.

The signal ground pins 33-1 and also 33-7, 33-8 and 33-14 are electrically connected to the signal ground of the back panel 22.

Through-holes 35 for mounting the shroud 40 are formed on the back panel 22 along both X1 and X2 side edges of the pin group 31 in the vertical Z1–Z2 direction. The through-holes 35 are electrically connected to the frame ground of the back panel 22.

Figure 7:
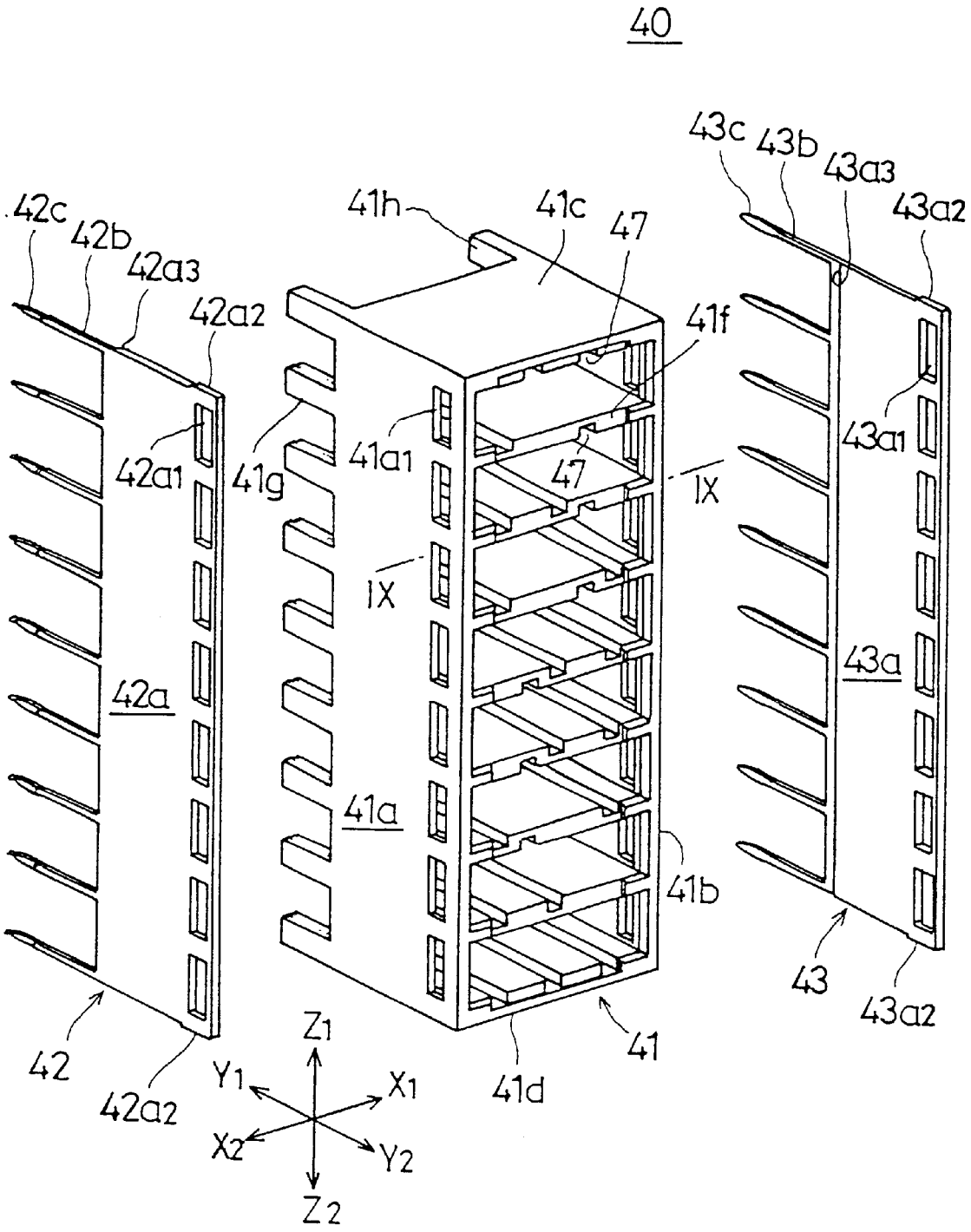
FIG. 7 is an exploded view of the shroud.

As shown in FIG. 2 and in FIG. 7, the shroud 40 has a rectangular shroud body 41 made of electrically insulative plastic and metallic shield plates 42 and 43 insert molded into both X1 and X2 sides of the shroud body. A plurality of shroud compartments 44-1 through 44-8 are closely spaced in the vertical Z1–Z2 direction.

Figure 8A:
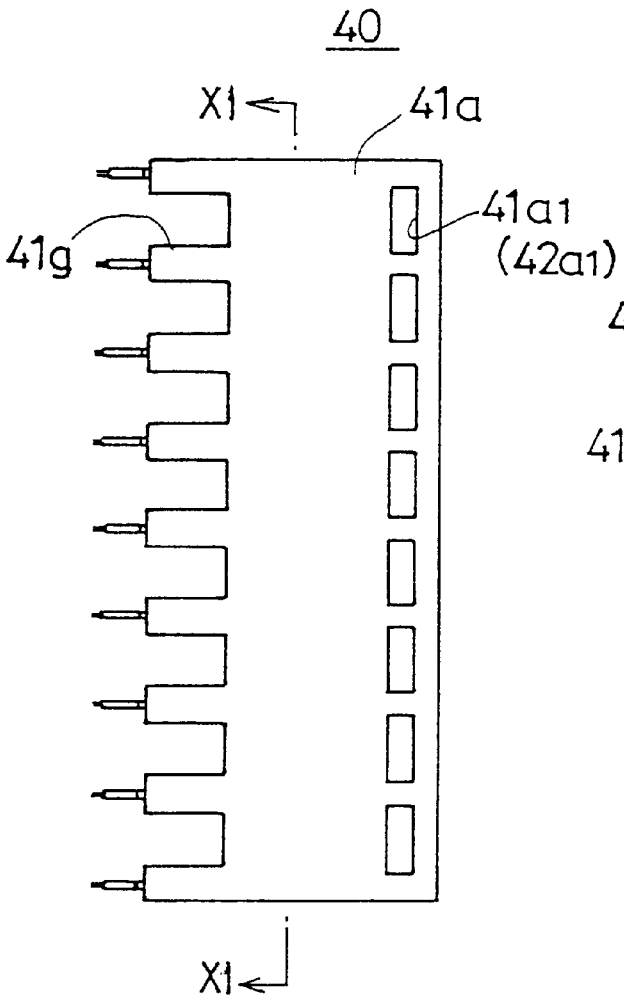
FIGS. 8A, 8B and 8C are side, top and front views, respectively, of the shroud.
Figure 8C:
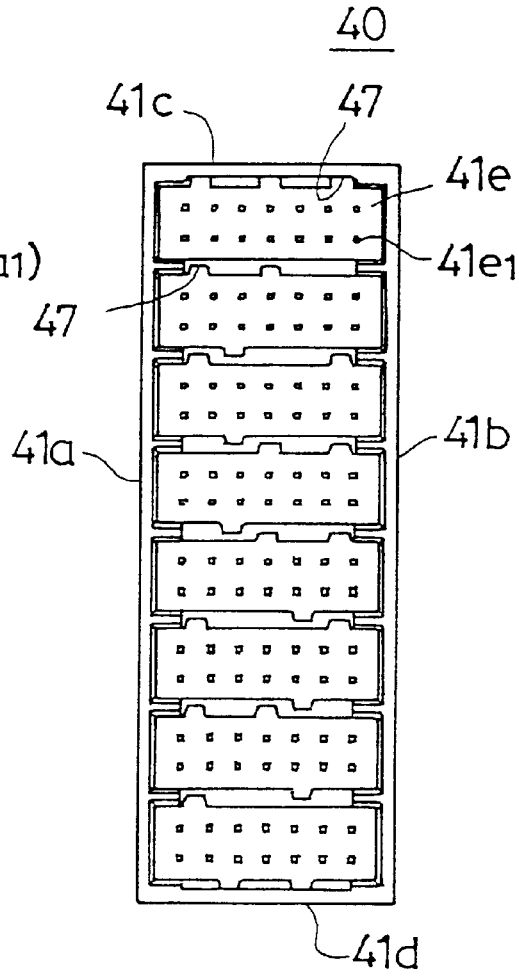
Figure 8B:
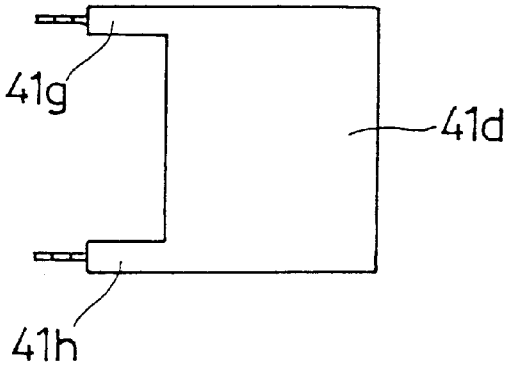

As shown in FIGS. 8A, 8B and 8C, the shroud body 41 comprises rectangular longer side panels 41*a* and 41*b*, shorter side panels 41*c* and 41*d*, bottom panel 41*e*, a plurality of partitions 41*f* and a plurality of stand-offs 41*g* and 41*h* dispersed and projecting from the side panels 41*a* and 41*b*.

The plurality of partitions 41*f* are aligned so as to be evenly spaced in the vertical Z1–Z2 direction. The stand-offs 41*g* and 41*h* are formed at positions corresponding to each of the plurality of partitions 41*f*. Rectangular openings 41*a*1 and 41*b*1 are formed in the side panels 41*a* and 41*b* at positions between adjacent partitions 41*f*.

Figure 9:
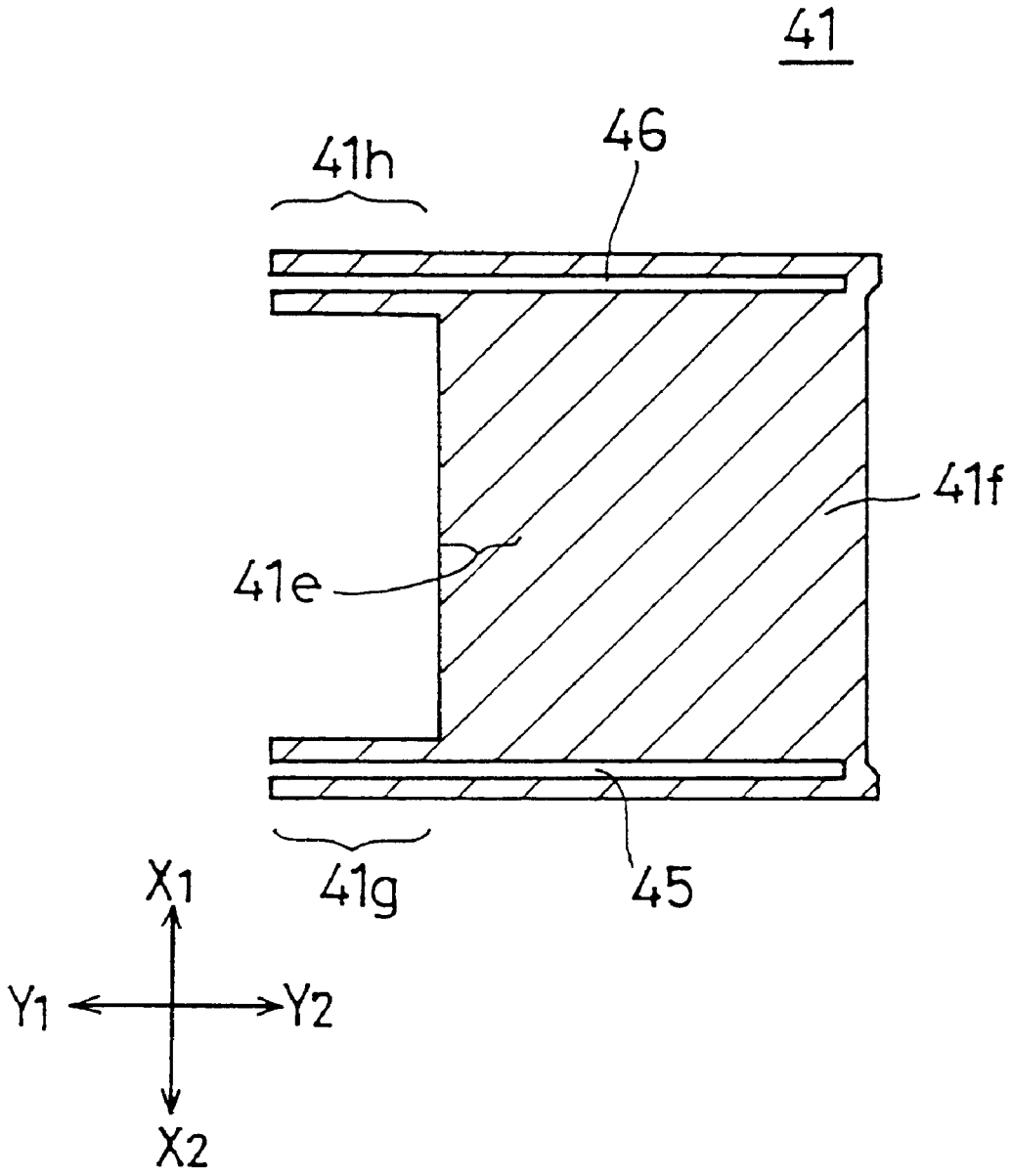
FIG. 9 is a cross-sectional view along a line IX—IX of the shroud of FIG. 7.

For convenience, FIG. 9 shows a cross-sectional view of the shroud body 41 in a state in which the metallic shield plates 42 and 43 are removed. In the drawing, reference numerals 45 and 46 are narrow spaces for inserting the shield plates 42 and 43.

The shield plates 42 and 43 comprise a body having approximately the same size as the side panels 41*a* and 41*b* and a plurality of leads 42*b* and 43*b* disposed like the teeth of a comb and projecting from the body 42*a* and 43*a* at positions corresponding to the stand-offs 41*g* and 41*h* mentioned previously, and pins 42*c* and 43*c* at the tips of the leads 42*b* and 43*b* having a press-fit structure. A lock opening 42*a*1 for engaging a latch is formed on the body 42*a* at positions between adjacent leads 42*b*. This opening 42*a*1 is used to lock a connected plug 51. Additionally, a lock opening 43*a*1 is formed on the body 43*a* at positions between adjacent leads 43*b*. Projections 42*a*2 and 42*a*3 are formed at both edges of the bodies 42*a* and 43*a* in the longer vertical direction so that the shield plates 42 and 43 do not come loose from the shroud body 41. Moreover, stepped portions 42*a*3 and 43*a*3 are formed on the bodies 42*a* and 43*a* where leads 42*b* and 43*b* project therefrom.

Figure 10:
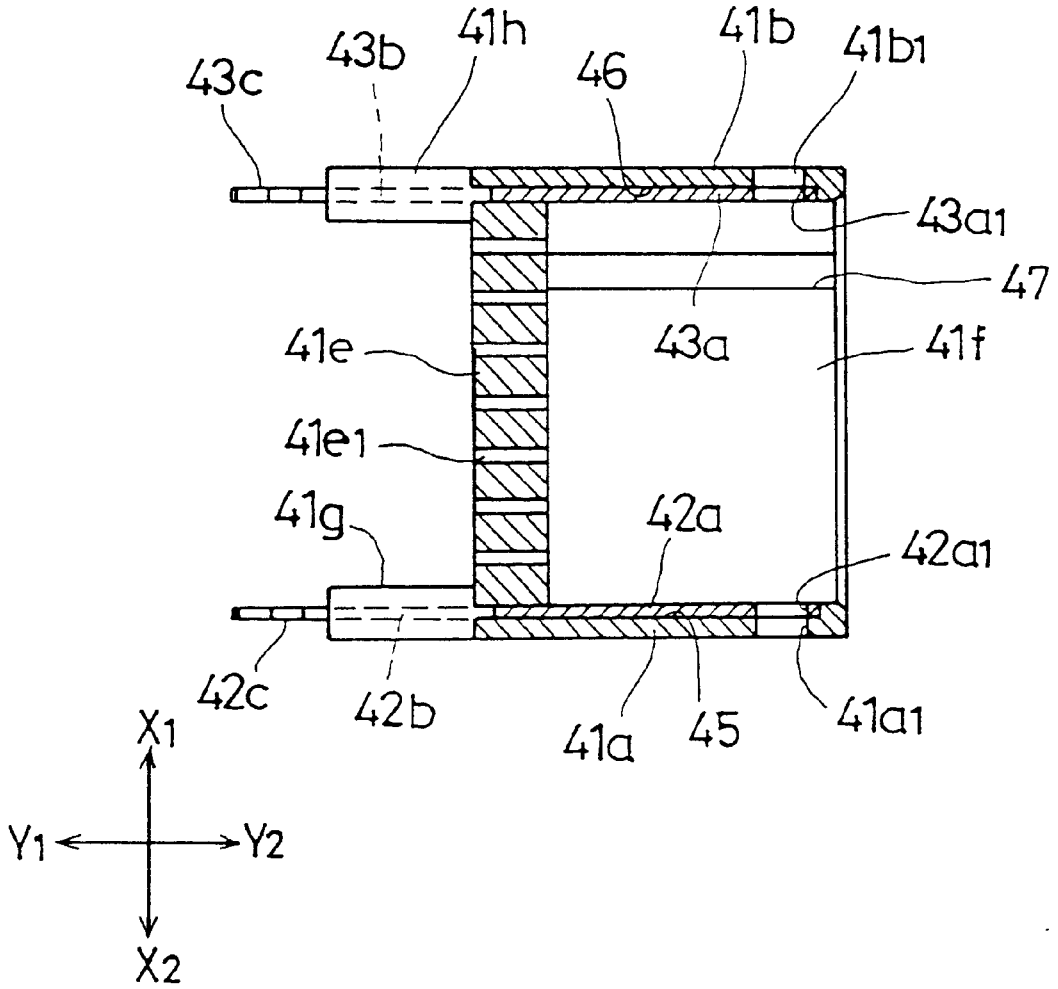
FIG. 10 is a cross-sectional view along a line X—X of the connector apparatus of FIG. 2.
Figure 11:
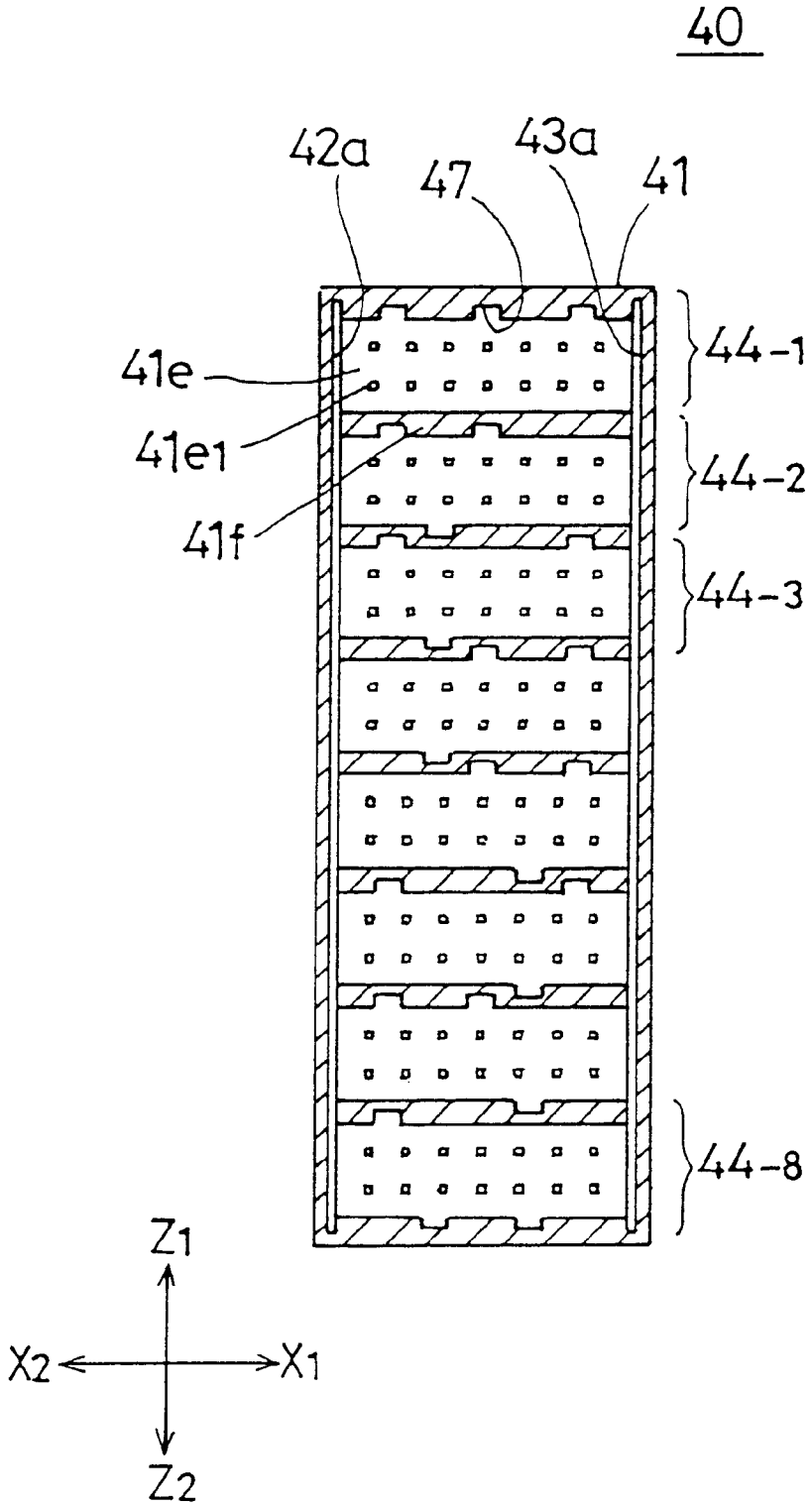
FIG. 11 is a cross-sectional view along a line XI—XI of the shroud of FIG. 8.

As shown in FIG. 10 and FIG. 11, the shield plates 42 and 43 are provided inside the narrow spaces 45 and 46 mentioned previously. The bodies 42*a* and 43*a* are exposed on an inner side of the shroud body 41 at the side panels 41*a* and 41*b*, and moreover are suppressed by both edges of each partition 41*f*. Lock openings 42*a*1 and 41*a*1 align, as do lock openings 43*a*1 and 41*b*1. Openings 41*a*1 and 41*b*1 are formed by projections of a mold that engage the lock openings 42*a*1 and 43*a*1 during insert molding. These openings 41*a*1 and 41*b*1 are used for visually checking the lock condition of the plug 51. The stand-offs 41*g* and 41*h* cover the leads 42*b* and 43*b*. Pins 42*c* and 43*c* project from the tips of the stand-offs 41*g* and 41*h*.

The shroud 40 is divided by partitions 41*f* into a plurality of shroud compartments 44-1 through 44-8.

Each of the shroud compartments 44-1 through 44-8 corresponds to one of a plurality of pin sub-plugs 32-1, 32-2, 32-3, and so forth, and moreover, has a size corresponding to the plug 51. The bodies 42*a* and 43*a* of the shield plates 42 and 43 are exposed on the inside of the X1 and X2 sides. A plurality of through-holes 41*e*1 are formed on the bottom panel 41*e*, in an alignment corresponding to the alignment of the pins 33-1 through 33-14.

Additionally, grooves 47 designed to prevent the mistaken insertion of a plug other than the plug that should be connected thereto are formed on the surfaces of the individual shroud compartments 44-1 through 44-8 disposed opposite a Z1–Z2 direction, that is, on the top and bottom surfaces of the partitions 41*f*. The disposition of the grooves 47 differs with each individual shroud compartment 44-1 through 44-8.

Figure 12A:
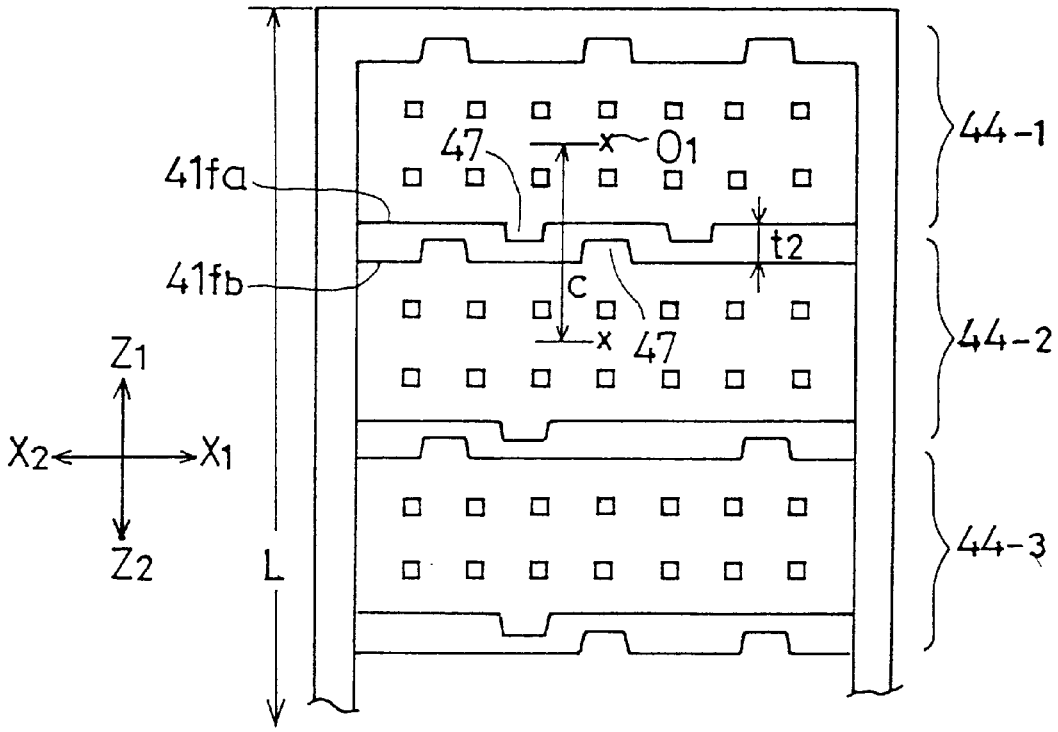
FIGS. 12A and 12B show an arrangement of grooves on shroud compartments designed to prevent improper insertion of a plug therein.

As shown in an expanded fashion in FIG. 12A, the grooves 47 are arranged so as to be asymmetrically distributed with respect to a center point O1 of any given shroud compartment 44-1, etc. Doing so prevents not only insertion of an incorrect plug 51 but also prevents even upside-down insertion of the correct plug 51.

Figure 12B:
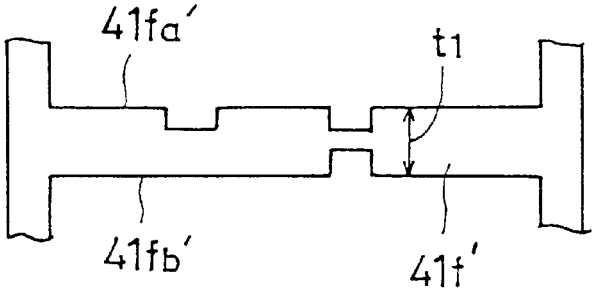

Additionally, as shown in FIG. 12B, if the grooves 100 for preventing improper insertion of a plug 51 are formed at the same position on both the top surface 41*fa*' and the bottom surface 41*fb*' of the partition 41*f*' in a direction of a thickness of the partition 41*f*', a thickness t1 of the partition increases, which is not preferable. In the present embodiment, the grooves in the top and bottom surfaces of the partition 41*f* are offset from each other with respect to the direction of the thickness of the partition 41*f*, that is, in a vertical Z1–Z2 direction. Accordingly, a thickness t2 of the partition 41*f* decreases, shortening a distance or pitch c between adjacent shroud compartments 44-1 through 44-8 and also shortening the length L of the shroud 40 in the vertical Z1–Z2 direction.

As shown in FIG. 3, the shroud 40 described above engages pins 33-1 through 33-14 which correspond to through-holes 41*e*1, pins 33-1 through 33-14 project into the inside of the shroud 40, the pins 42*c* and 43*c* having the press-fit construction are pressed into the through-holes 35 in the back panel 22 and the tips of the stand-offs 41*g* and 41*h* contact the back surface of the back panel 22. As a result, less back panel 22 back surface area is required to mount the shroud 40 as compared to a case in which screws are used to fixedly mount the shroud 40.

Additionally, as shown in FIG. 3, of the entire length of the pins 33-1 through 33-14 that portion thereof 76 which corresponds to the standoffs 41*g* and 41*h* is used as the wire wrapping area for accommodating alterations in the wiring pattern of the back panel 22.

With the shroud 40 engaging the pins 33-1 through 33-14 and mounted on the back panel 22 as described above, a connector 48 is configured on top of the back panel 22.

Figure 13:
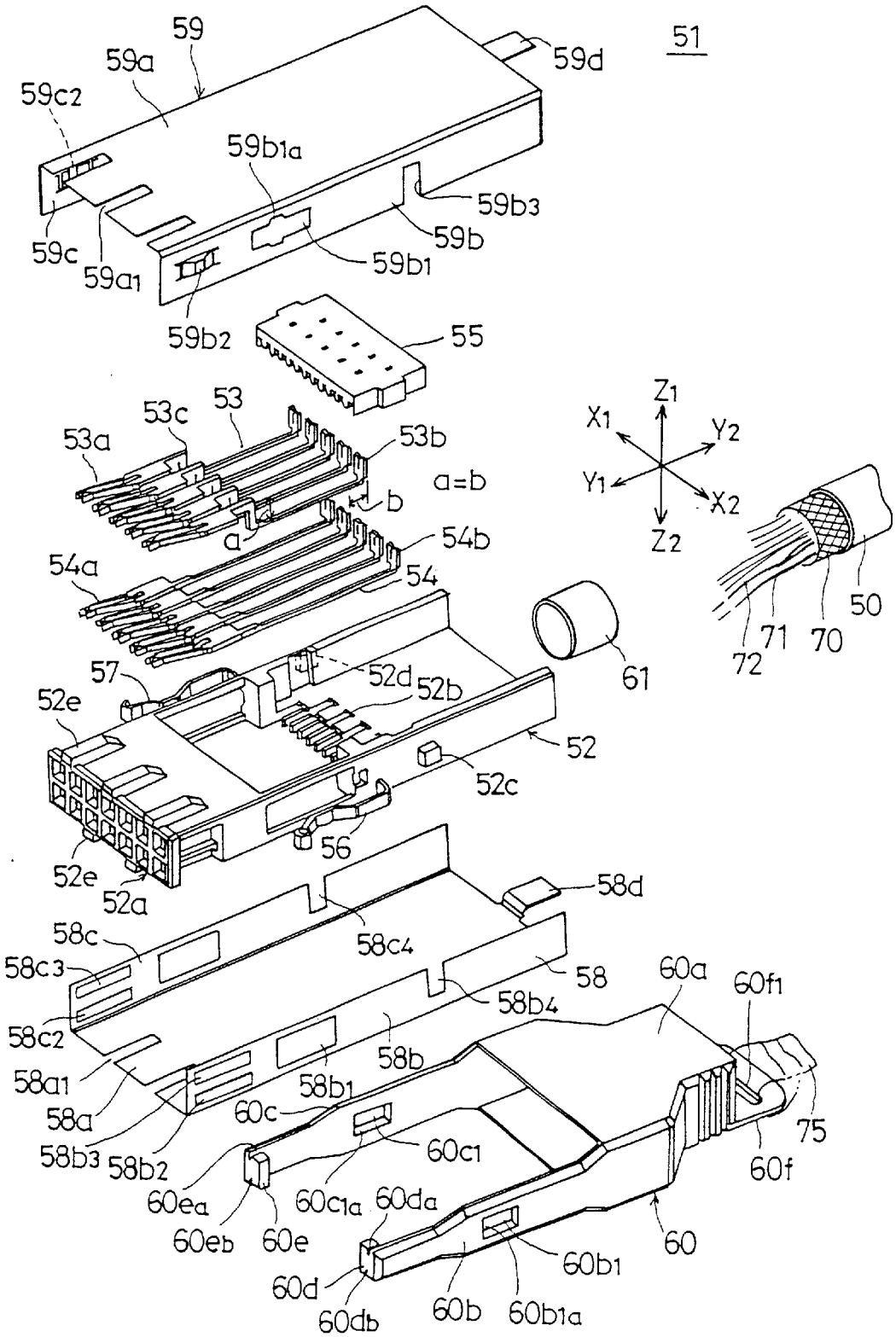
FIG. 13 is an exploded view of a cable connector.

As shown in FIG. 13, FIG. 2 and FIG. 3, the plug 51 has a size suitable for insertion into a shroud compartment 44-1 and has a longer longitudinal dimension in the Y1–Y2 direction, and comprises an electrically insulative plastic housing 52, a first signal contact and a second signal contact and a wire retaining member 55 made of electrically insulative plastic all included within an interior of the housing 52, metallic latch members 56 and 57 mounted on both sides of the housing 52, a metallic lower shield cover 58, a metallic top cover 59 and a lock release member 60 made of electrically insulative plastic.

The first signal contact 53 has a fork-shaped first pin contacting part 53*a* on a forward Y1 side tip of the first signal contact 53 and a fork-shaped first wire mounting 53*b* projecting upward in the Z1 direction, the first wire mounting 53*b* located at a rear Y2 side tip of the first signal contact 53. At an intermediate point the first signal contact 53 has a bent portion 53*c* of length a and has a substantially crank-shaped form from the forward Y1 direction toward the rear Y2 direction, the arm of the crank dropping downward in the Z2 direction.

The second signal contact 54 forms a straight line, and has a fork-shaped second pin contacting part 54*a* at a forward Y1 side tip and a fork-shaped second wire mounting 54*b* located at a rear Y2 side tip and projecting upward in the Z1 direction.

The housing 52 has a pin contacting part retainer 52*a* at a forward Y1 edge side, a wire mounting positioning groove 52*b* on a top surface of an approximately central portion extending along the longitudinal Y1–Y2 axis, projections 52*c* and 52*d* on both side surfaces of the approximately central portion extending in the longitudinal Y1–Y2 direction and projection-like keys 52*e* for preventing improper insertion, the keys 52*e* being positioned at both a top surface and a bottom surface of the pin contacting part retainer 52*a* along a forward Y1 edge thereof.

Figure 14:
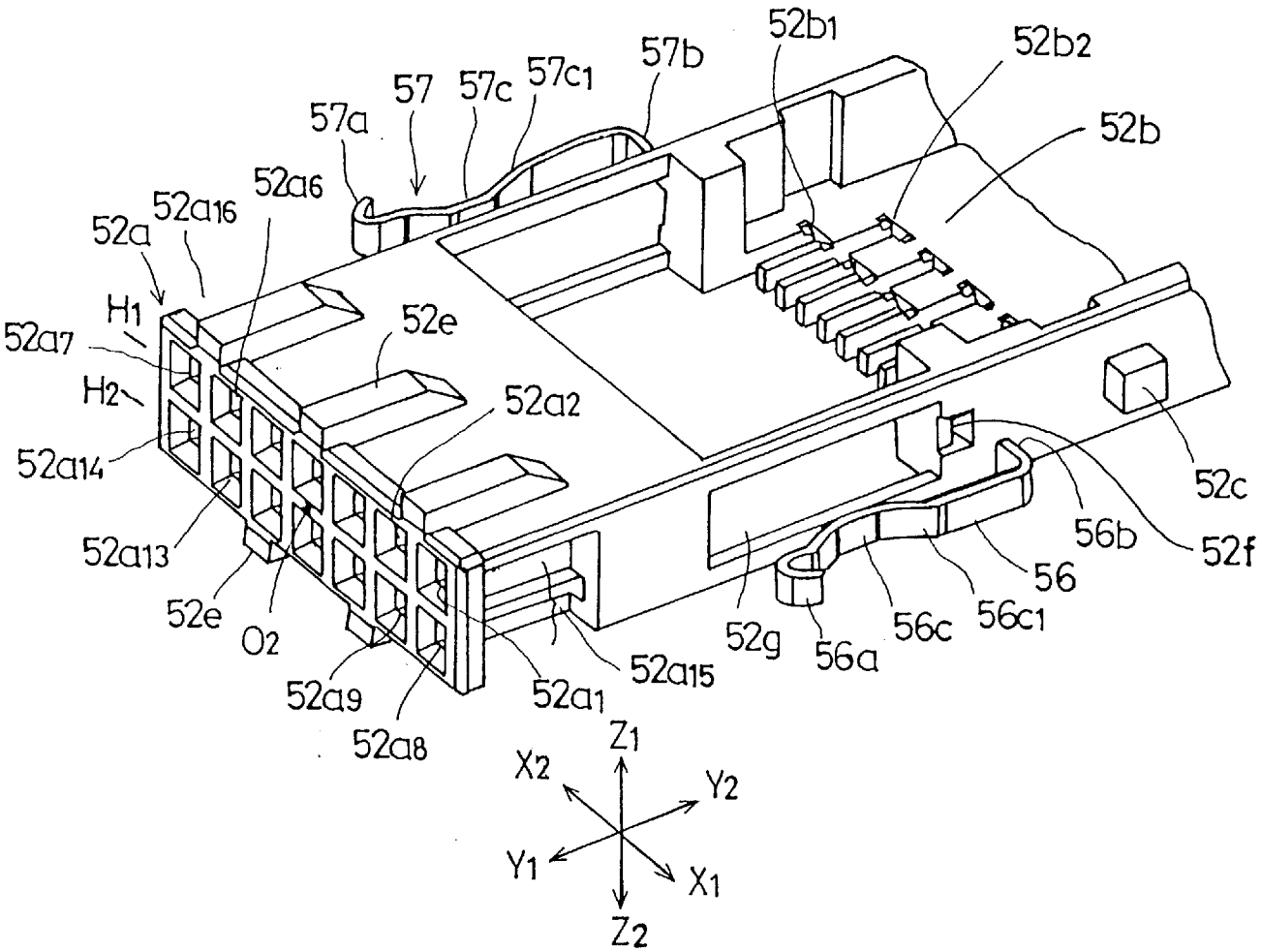
FIG. 14 is an exploded view of a housing.

As seen in an exploded view in FIG. 14, the pin contacting part retainer 52*a* comprises two rows of seven tunnels, including seven upper tunnels 52*a*1 through 52*a*7 aligned side by side in a lateral X1–X2 direction at a height H1 and seven lower tunnels 52*a*8 through 52*a*14 also arranged side by side in the lateral X1–X2 direction at a height H2. An X1 side of tunnels 52*a*1 and 52*a*8 on an X1 side edge are open to form a window 52*a*15, and a window 52*a*16 is similarly formed on an X2 side of tunnels 52*a*7 and 52*a*14 on an X2 side edge. Into these windows 52*a*15 and 52*a*16 are inserted contacts 58B*b*2, 58B*b*3, 58B*c*2 and 58B*c*3, shown in FIG. 19 and to be described later.

Similarly, as shown in FIG. 14, the wire mounting positioning groove 52*b* comprises a first wire mounting positioning groove 52*b*1 and a second wire mounting positioning groove 52*b*2, disposed on a flat surface having a height approximately the same as the height H2 mentioned previously.

The first signal contact 53 is attached in such a way that the first pin contacting part 53*a* is inserted into the upper H1-position tunnels 52*a*2 through 52*a*6, that is, excepting the two tunnels 52*a*1 and 52*a*7 at both sides, and the first wire mounting 53*b* is engaged by the wire mounting positioning groove 52*b*1. The second signal contact 54 is attached in such a way that the second pin contacting part 54*a* is inserted into the lower H2-position tunnels 52*a*9 through 52*a*13, that is, excepting the two tunnels 52*a*8 and 52*a*14 at both sides, and the second wire mounting 54*b* is engaged by the groove 52*b*.

From the longitudinal Y1–Y2 direction, the first pin contacting part 53*a* and the second pin contacting part 54*a* are in the same position, with the first wire mounting 53*b* disposed closer to a forward Y1 direction than the second wire mounting 54*b* by a dimension b as seen in FIG. 13. This dimension b is equivalent to the length a of the bent portion 53*c* described above. Accordingly, a length along the first contact 53 between the first pin contacting part 53*a* and the first wire mounting 53*b* of the first signal contact 53 is equivalent to a length along the second contact 54 between the second pin contacting part 54*a* and the second wire mounting 54*b* of the second signal contact 54. As will be explained later, this is to prevent the occurrence of a time lag, or skew, between the positive signal and the negative signal of a differential data transfer.

The keys 55*e* for preventing improper insertion are positioned at locations corresponding to the grooves 47 on the shroud compartments 44-1 through 44-8. The position of a given key 55*e* differs with each plug 51 and only the corresponding plug for a given shroud compartment 44-1 through 44-8 is inserted therein and connected thereto, with all other plugs restricted from entering the opening of the shroud compartment. Accordingly, the improper insertion of a plug into a shroud compartment other than the shroud compartment for that plug is prevented.

Additionally, the keys 55*e* are arranged so as to be asymmetrical with respect to a center O2 of a edge surface in the forward Y1 direction of the pin contacting part retainer 52*a*. Accordingly, even upside-down insertion of the correct plug 51 is prevented.

The cable 50 has at its tip a shield mesh 70 which, together with a tongue portion 58*d* of the lower shield cover 58 and a tongue portion 59*d* of the upper shield cover 59, is clamped by a metallic ring 61 compressed and fixedly mounted to the plug 51. A positive signal wire 71 and a negative signal wire 72 of the same length are extended from the tip of the cable 50. The first wire mounting 53*b* is pressed onto The tip of the positive signal wire 71 is pressed into the first wire mounting 53*b* and the tip of the negative signal wire 72 is pressed onto the second wire mounting 54*b*, and, further, are suppressed by the wire retaining member 55 and connected to the first signal contact 53 and to the second signal contact 54, respectively. The wire retaining member 55 engages an interior of the housing 52 and its movement in the longitudinal Y1–Y2 direction is restricted.

The latch members 56 and 57 have at a front edge hooks 56*a* and 57*a*, respectively, at a base side bent portions 56*b* and 57*b*, and shallow U-shaped base intermediate portions 56*c* and 57*c*. As shown also in FIG. 5, the bent portions 56*b* and 57*b* on the base sides of the latch members 56 and 57 engage a concavity 52*f* of the housing 52, and further, an outer side is elastically suppressed by side panels 58*b* and 58*c* of the lower shield cover 58. The base portions 56*c* and 57*c* advance into the inside of the housing 52 by passing through the housing window 52*g*. The base portions 56*c* and 57*c* have inclined portions 56*c*1 and 57*c*1 near the bent portions 56*b* and 57*b*.

As shown in FIG. 13, the lower shield cover 58 comprises a bottom panel 58*a*, side panels 58*b* and 58*c* in both lateral X1 and X2 directions and a tongue portion 58*d* on a rear Y2 side thereof. The upper shield cover 59 comprises a cover panel 59*a*, side panels 59*b* and 59*c* in both lateral X1 and X2 directions and a tongue portion 59*d* on a rear Y2 side thereof. The lower shield cover 58 and the upper shield cover 59 are mounted so that the bottom panel 58*a* covers a bottom surface of the housing 52, the cover panel 59*a* covers the first signal contact 53 and the second signal contact 54, thus enclosing the whole of the housing 52. Side panels 59*b* and 59*c* are positioned outside of side panels 58*b* and 58*c*.

Outwardly projecting contacts 59*b*2 and 59*c*2 are formed on the side panels 59*b* and 59*c* of the upper shield cover 59, near the forward Y1 edge of thereof. These contacts 59*b*2 and 59*c*2 contact the shield plates 42 and 43. Further, openings 58*b*2, 58*b*3, 58*c*2 and 58*c*3 are formed on the side panels 58*b* and 58*c* of the lower shield cover 58, near a forward Y1 edge thereof and at positions corresponding to windows 52*a*15 and 52*a*16. These are for electrically dividing the signal ground and the frame ground.

Notches 58*a*1 and 59*a*1 corresponding to keys 55*e* are formed on the forward Y1 edges of the bottom panel 58*a* of the lower shield cover 58 and the cover panel 59*a* of the upper shield cover 59, respectively.

Figure 15A:
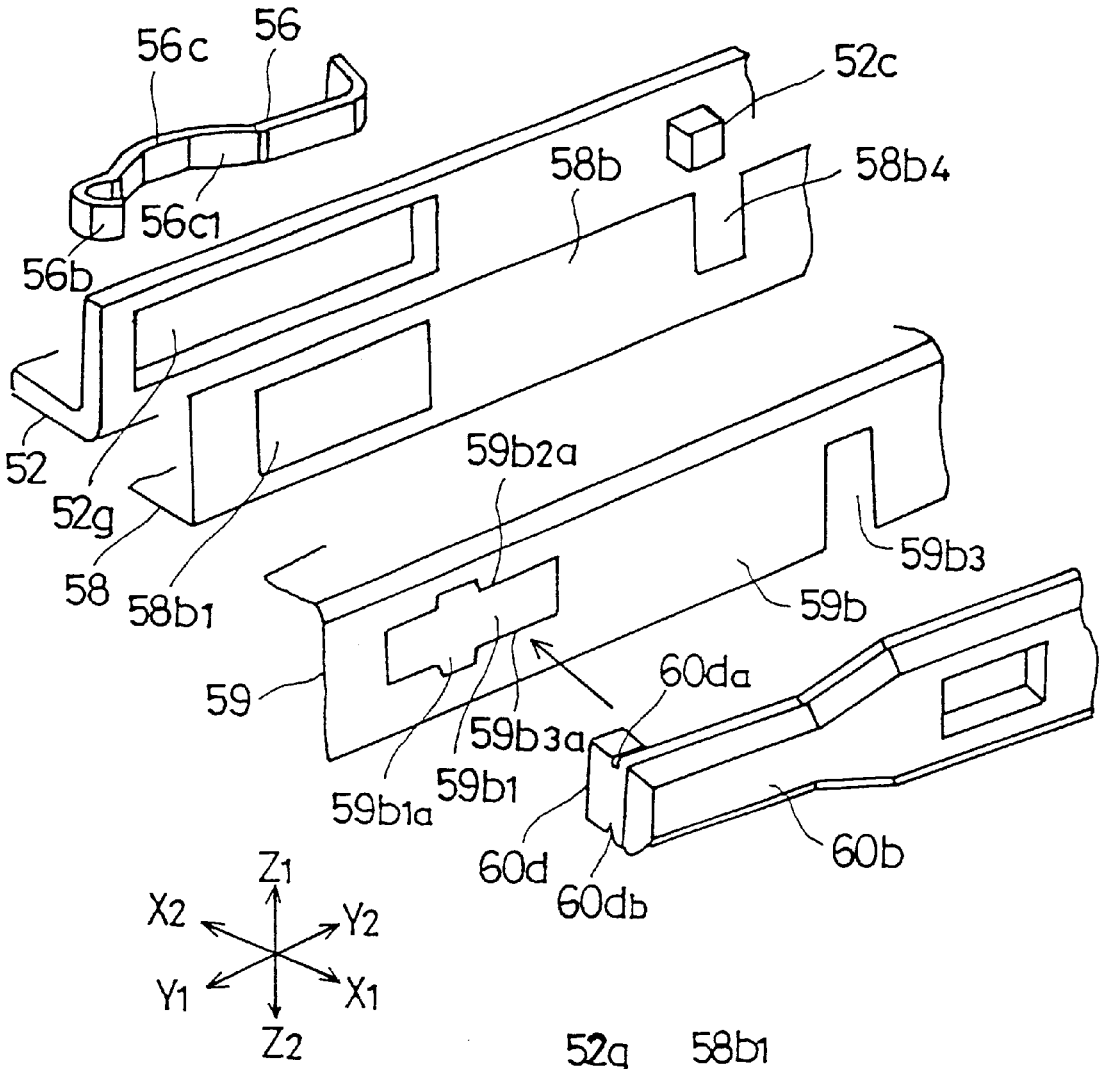
FIGS. 15A and 15B are diagrams showing exploded and frontal views of a structure of a projection and a surrounding area thereof, respectively.

As shown in FIGS. 13 and 15A, a guide opening 59*b*1 having a longer longitudinal dimension in the Y1–Y2 direction is formed on the side panels 59*b* and 59*c* of the upper shield cover 59, though the guide opening in the side panel 59*c* is not shown in the drawing. This guide opening 59*b*1 has a widened portion 59*b*1*a* widened in the vertical Z1–Z2 direction at a point just forward of a center in the forward Y1 direction. This widened portion 59*b*1*a* is formed so as to accommodate a projection 60*d*. Reference numerals 59*b*2*a* and 59*b*3*a* are edge-formed guides disposed so as to face a guide opening 59*b*1 in the side panel 59*b*, and extend in the longitudinal Y1–Y2 direction.

The lock release member 60 comprises a box 60*a*, arms 60*b* and 60*c* extending from the lateral X1–X2 sides of the box 60*a* parallel to the Y1 direction, projections 60*d* and 60*e* projecting so as to oppose an inner side of an edge in the forward Y1 direction of the arms 60*b* and 60*c*, and a pull tab 60*f* extending toward a rear Y2 direction from the box 60*a*.

As depicted in FIG. 3, the box 60*a* just encloses the tip of the cable 50, and a forward Y2 edge portion of the upper shield cover 59 and the lower shield cover 58.

The arms 60*b* and 60*c* extend along the side panels 59*b* and 59*c* of the upper shield cover 59 that in turn covers the housing 52. Openings 60*b*1 and 60*c*1 in the arms 60*b* and 60*c* engage the projections 52*c* and 52*d* described above.

Projections 60*d* and 60*e* are substantially rectangular and have a size corresponding to the widened portion 59*b*1*a* described above, with guide grooves 60*da*, 60*db*, 60*ea* and 60*eb* formed near the arms 60*b* and 60*c*. Guide grooves 60*da*, 60*db*, 60*ea* and 60*eb* are cut out of a Z1 side surface and a Z2 side surface so as to correspond to guide opening 59*b*, and extend in the longitudinal Y1–Y2 direction.

Figure 15B:
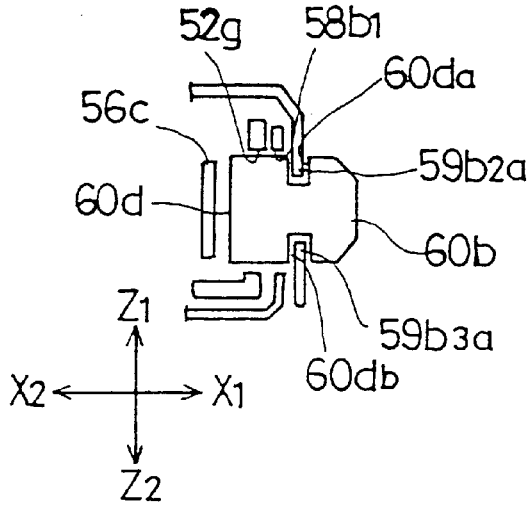

In a state prior to the connection of the plug 51 as shown in FIG. 3, the projection 60*d* is inserted inside the guide opening 59*b*1 in the X2 direction through the widened portion 59*b*1*a*, and is positioned at a position slightly displaced in the rear Y2 direction. As shown in FIG. 15B, guide grooves 60*da* and 60*db* engage edge-formed guides 59*b*2*a* and 59*b*3*a*, respectively. Projection 60*d* passes through the opening 58*b*1 in side panel 58*b* of lower shield cover 58 and the housing window 52*g*, and projects into the interior of the housing 52 in such a way as to oppose the base portion 56*c* of the latch member 56. As shown in FIG. 3, with separate projection 60*e*, as with projection 60*d* described above, guide grooves 60*ea* and 60*eb* engage edge-formed guides and a tip of the projection 60*e* opposes a base portion 57*c* of the latch member 57.

The lock release member 60, as noted previously, has a box portion 60*a* which encloses the housing 52. The projections 60*d* and 60*e* engage the housing window 52*g* so as to support the lock release member 60 in such a way that the lock release member 60 is movable in the Y2 direction.

As shown in FIG. 13, a tag 75 is attached to the pull tab 60*f* by using a slit 60*f*1 indicating the type of signal the plug 51 handles and the position at which the plug 51 is attached. This tag 75 is also used instead of the pull tab 60*f* by an operator to remove the plug 51.

In the above-described plug 51, the lower and upper shield covers 58 and 59 are mounted on the housing 52 as follows. Longitudinally in the Y1–Y2 direction notch 58*b*4 of side panel 58*b* and notch 59*b*3 of side panel 59*b* engage projection 52*c*. Additionally, notch 58*c*4 of side panel 58*c* and a notch not shown of side panel 59*c* engage projection 52*d*. Vertically, that is, in the Z1–Z2 direction, mounting is accomplished by a ring 61 located on a Y2 side while on a Y1 side projections 60*d* and 60*e* engaging housing window 52*g* further engage guide openings 59*b*1 and 58*b*1.

Next, descriptions will be given of an operation of connecting the above-described plug 51 to the shroud 40, of a state of connection of the plug 51 to the shroud 40 and of an operation of pulling out the plug 51 from the shroud 40.

As shown in FIGS. 2 and 3, the plug 51 is inserted right side up into a particular shroud compartment, for example shroud compartment 44-1, up to a final position beyond which insertion is restricted. The keys 55*e* and the groove 47 prevent the insertion of the plug in a different shroud compartment and prevent the upside down insertion of the plug in the correct shroud compartment.

A description will now be given of a connected state. As shown in FIG. 4, the first pin contacting part 53*a* is connected to the positive signal pins 33-2 through 33-6, the second pin contacting part 54*a* is connected to the corresponding negative signal pins 33-9 through 33-13, the contacts 59*b*2 and 59*c*2 are elastically contacted with the bodies 42*a* and 43*a* of the shield plates 42 and 43, respectively, and hooks 56*a* and 57*a* engage openings 41*a*1 and 41*b*1 in the shield plates 42 and 43.

The shield plates 42 and 43 of the shroud 40 are electrically connected to the frame ground of the back panel 12 and the shield covers 58 and 59 which cover the plug 51 are electrically connected to the frame ground of the back panel 12 via the shield plates 42 and 43. As a result, the effects of EMI, ESI and ESD are countered and EMC improved for the first signal contact 53, the second signal contact 54 and the wires 71 and 72 inside the plug 51 as well as for the signal pin and the signal ground pin inside the shroud compartment 44-1.

Additionally, the lengths of the first signal contact 53 and the second signal contact 54 are adjusted and the occurrence of a time lag or skew between the positive signal and the negative signal of a differential data transfer is suppressed, making it possible to transmit data with a high degree of reliability at speeds as high as, for example, 1 Gigabit per second.

Additionally, hooks 56*a* and 57*a* engage openings 41*a*1 and 41*b*1, locking plug 51 into shroud compartment 44-1. As a result, the plug 51 will not come loose from the shroud 40 even if the cable 50 were to be mistakenly pulled with a strong force F1. Additionally, this force F1 is absorbed by the metallic shield plates 42 and 43, so the plastic shroud body 41 is not cracked or otherwise damaged. Additionally, when viewed from the front the shroud 40 is mounted in such a way that each of the shroud compartments 44-1 is fixedly mounted to the back panel 22 at the four corners of the shroud openings by the leads 42*b* and 43*b* and the press-fit pins 42*c* and 43*c*. Additionally, the force F1 is also absorbed by the press-fit pins 42*c* and 43*c* pressed into the through-holes 35 in the back panel 22 at shroud compartments other than shroud compartment 44-1. Accordingly, the shroud 40 does not come loose from the back panel 22.

Additionally, a plurality of plugs 51 are closely spaced in the vertical Z1–Z2 direction and the density of connection is thus high because the distance, or pitch, between the individual shroud compartments 44-1 through 44-8 is short.

Additionally, it is possible to visually inspect the engagement of hooks 56*a* and 57*a* with openings 41*a*1 and 41*b*1, respectively, in respective shield plates 42 and 43 through openings 41*a*1 and 41*b*1.

A description will now be given of the releasing of the plug 51 from the shroud 40.

The tag 75 and the pull tab 60*f* are pulled in the Y2 direction. By this operation, as shown in FIG. 5, the lock release member 60 moves in the Y2 direction, the projections 60*d* and 60*e* press the inclined portions 56*c*1 and 57*c*1 of the latch members 56 and 57, the latch members 56 and 57 are in turn elastically bent in the direction of a center of the plug 51, the hooks 56*a* and 57*a* are released from the openings 41*a*1 and 41*b*1 and the lock released. At the same time as the lock is released an inner surface 60*b*1a and 60*c*1a in the Y1 direction of the openings 60*b*1 and 60*c*1 contact the projections 52*c* and 52*d*, a force pulling on the tag 75 or the pull tab 60*f* is transmitted to the housing 52, the plug 51 is extracted from the shroud compartment 44-1 and the connection of the plug 51 to the shroud compartment 44-1 is released. That is, the single operation of pulling the tag 75 and the pull tab 60*f* in the rear Y2 direction accomplishes the two operations of releasing the lock and extracting the plug 51. The operation of releasing the connection of the plug 51 is achieved by the single operation of pulling the tag 75 or the pull tab 60*f* in the Y2 direction, thus improving operability.

Additionally, the latch members 56 and 57 do not bend significantly because the inner surfaces 60*b*1*a* and 60*c*1*a* of the openings 60*b*1 and 60*c*1 in the forward Y1 direction contact projections 52*c* and 52*d* at the same time as the lock is released. Additionally, the force pulling the tag 75 or the pull tab 60*f* in the rear Y2 direction is securely transmitted to the plug 51, and, moreover, to both lateral sides of the plug 51. Accordingly, the plug 51 can be pulled out with ease from the shroud 44-1.

Additionally, the tag 75 extends rearward from the pull tab 60*f*. Accordingly, where a plurality of plugs 51 are closely spaced in the vertical Z1–Z2 direction and it is difficult to get hold of the pull tab 60*f* itself, it is still easy to get hold of the tip of the tag 75. Accordingly, by using the tag 75 it is possible to easily release a given desired plug 51 even where a plurality of plugs 51 are closely spaced in the vertical Z1–Z2 direction.

When the tag 75 or the pull tab 60*f* is released, the inclined portions 56*c*1 and 57*c*1 press the projections 60*d* and 60*e* back in the Y1 direction by the spring force of the latch members 56 and 57 themselves, the lock release member 60 is automatically returned slightly in the Y1 direction to the state shown in FIG. 3. Accordingly, it is not necessary to separately return the lock release member 60 to its original position after pulling the plug 51, thus improving operability.

Additionally, the guide grooves 60*da* and 60*db* of the projections 60*d* and 60*e* are guided by edge-formed guides 59*b*2*a* and 59*b*3*a*, respectively, such that displacement in the lateral X1–X2 direction is restricted. Accordingly, when moving in the Y2 direction the projections 60*d* and 60*e*, though pressed by the outside of the plug 51 via the latch members 56 and 57, are not much displaced thereby. Accordingly, the lock release member 60 securely elastically bends in a direction to release the hooks 56*a* and 57*a* of the latch members 56 and 57 from the openings 41*a*1 and 41*b*1, thus securely releasing the lock. Additionally, arms 60*b* and 60*c* do not float off the side surfaces of the plug and the plug thus does not expand laterally in the X1–X2 direction.

Figure 16:
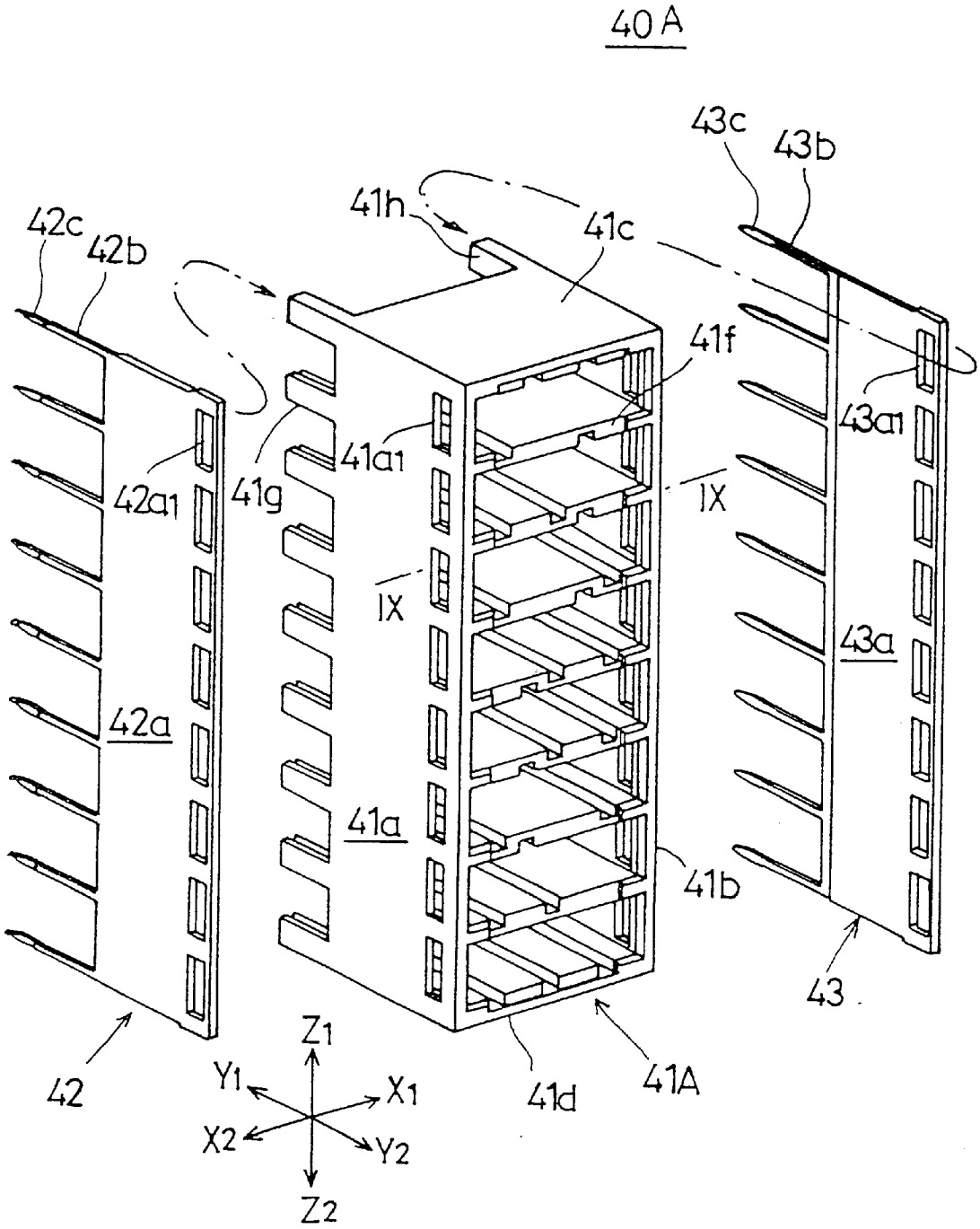
FIG. 16 is an exploded view of a variation of the shroud.
Figure 17:
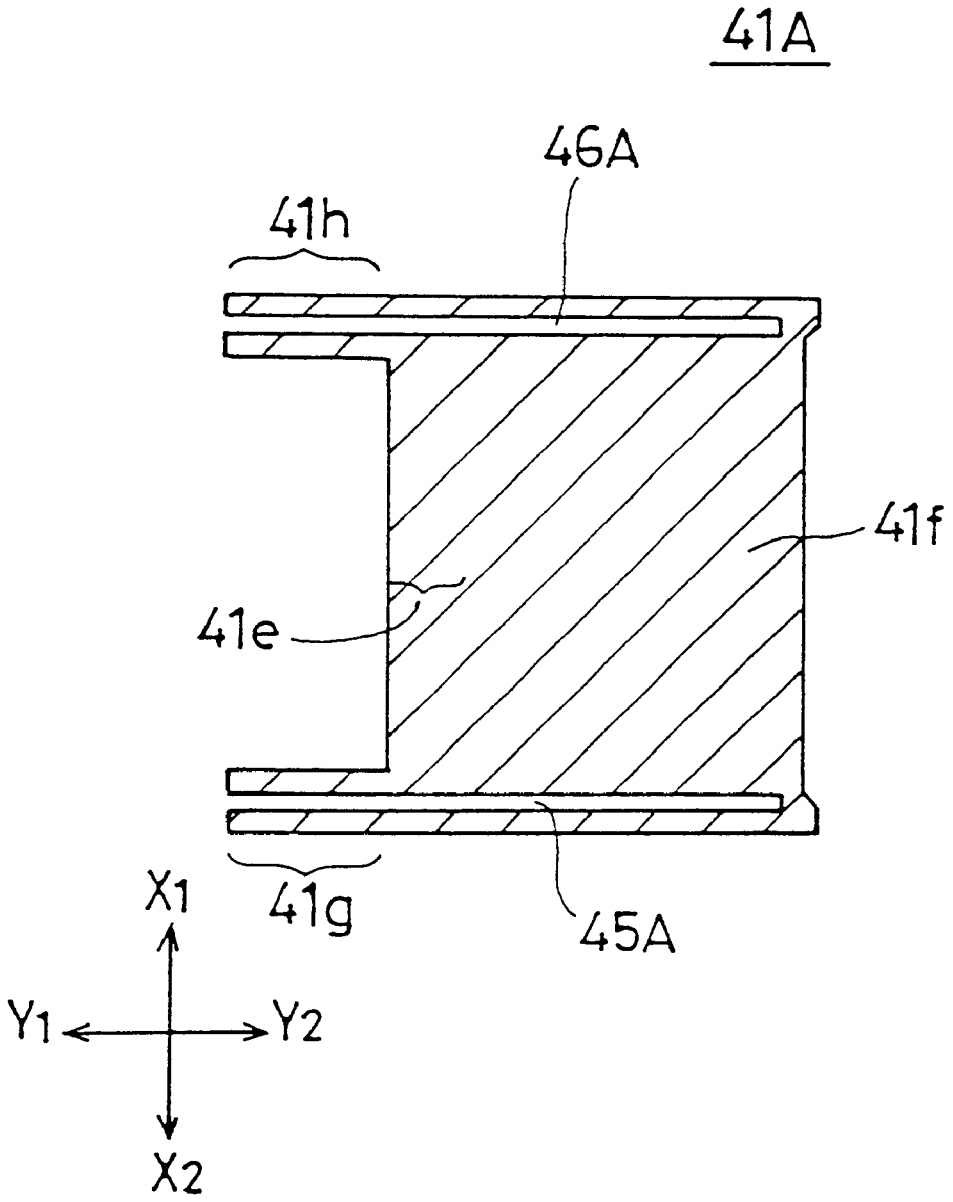
FIG. 17 is a cross-sectional view along a line XVII—XVII of the shroud of FIG. 16.

A description will now be given of a variation of the shroud 40, with reference to FIGS. 16 and 17.

A shroud 40A has a construction such that shield plates 42 and 43 are pressed into and fixedly mounted on interior grooves 45A and 46A on both sides of a shroud body 41A from a bottom surface of the shroud 40A.

A description will now be given of a second embodiment of the present invention, with reference to FIGS. 18 and 19.

Figure 18:
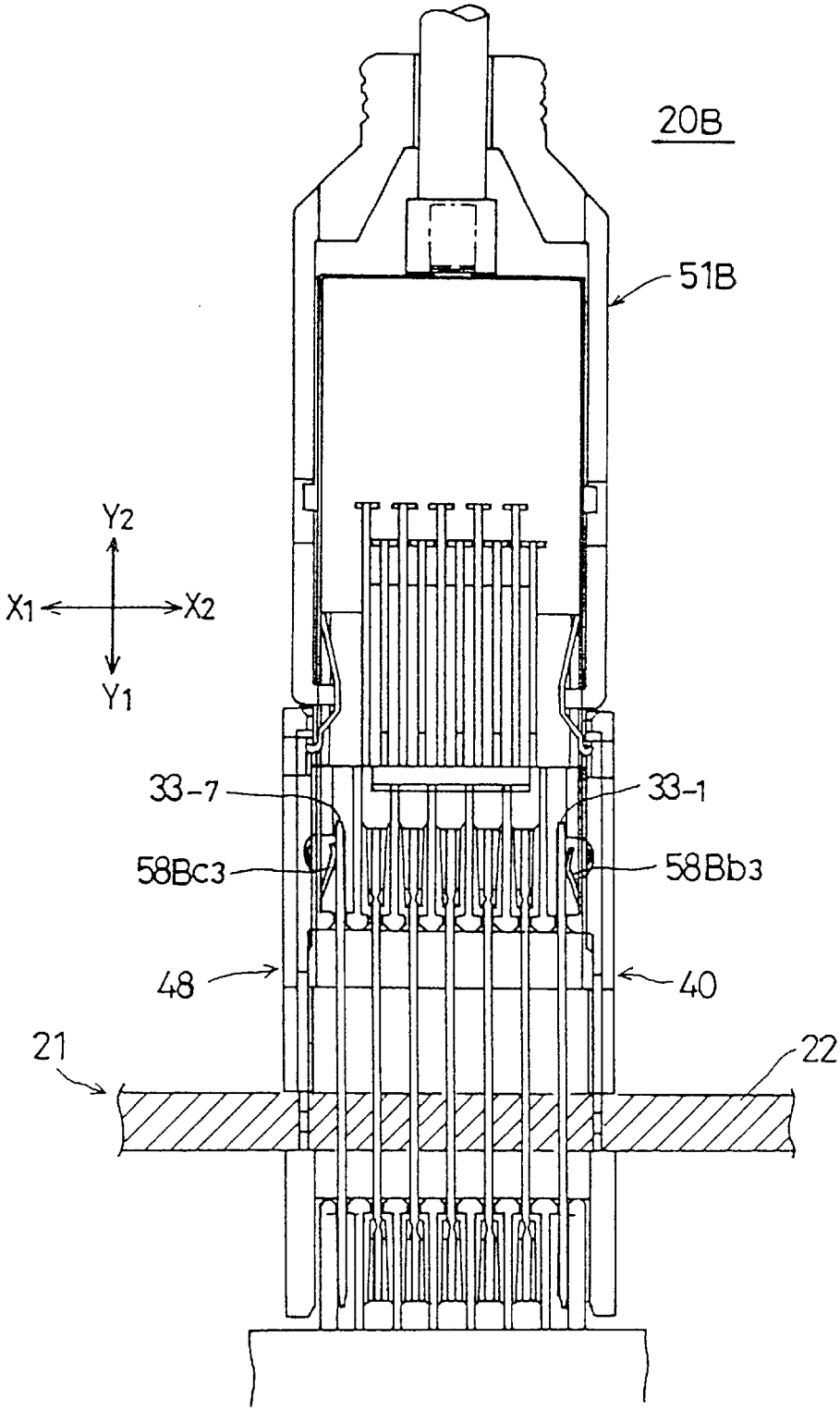
FIG. 18 is a diagram showing a state of connection of a connector apparatus according to a second embodiment of the present invention.
Figure 19:
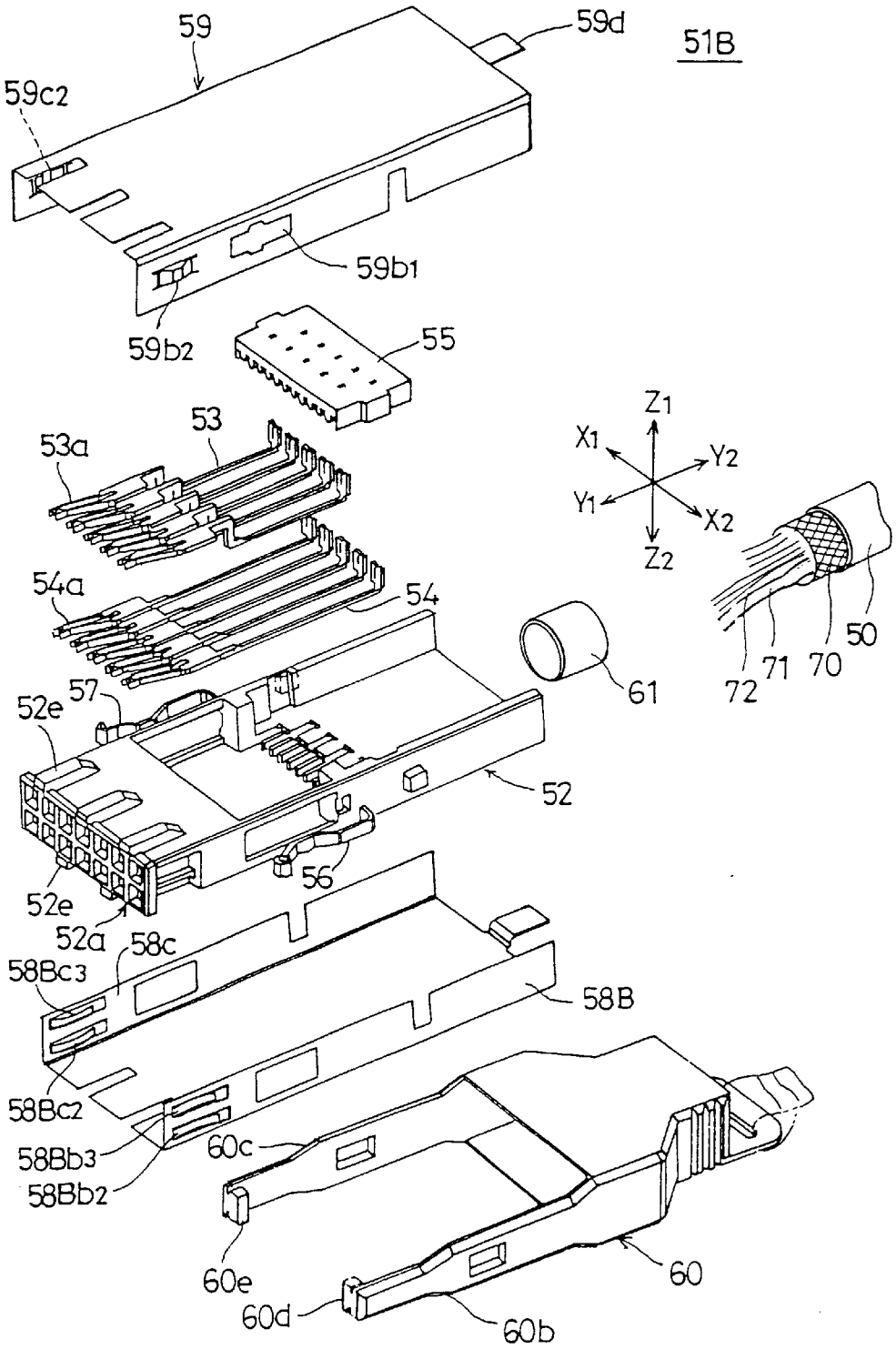
FIG. 19 is an exploded view of the plug shown in FIG. 18.

FIG. 18 shows a connected state of a connector assembly 20B according to a second embodiment of the present invention. The connector assembly 20B has a structure suitable for a case in which the signal ground of the back panel 22 has the same potential as the frame ground, the only difference between the present embodiment and the first embodiment of the connector assembly 20 being a plug 51B. As shown in FIG. 19, the plug 51B differs from the plug 51 above only with respect to the lower shield cover 58B. The lower shield cover 58B differs from the lower shield cover 58 shown in FIG. 13 only in that contacts 58B*b*2, 58B*b*3, 58B*c*2 and 58B*c*3 which project into an interior of the lower shield cover 58B are formed at the location of openings 58*b*2, 58*b*3, 58*c*2 and 58*c*3.

As shown in FIG. 18, a plug 51B is connected to the shroud 40. Contacts 58B*b*2, 58B*b*3, 58B*c*2 and 58B*c*3 contact signal ground pins 33-1, 33-7, 33-8 and 33-14. Accordingly, the potential at the signal ground of the back panel 22 is the same as that at the frame ground of the back panel 22 via the lower shield cover 58B and the upper shield cover 59, and further, the shield plates 42 and 43.

Figure 20:
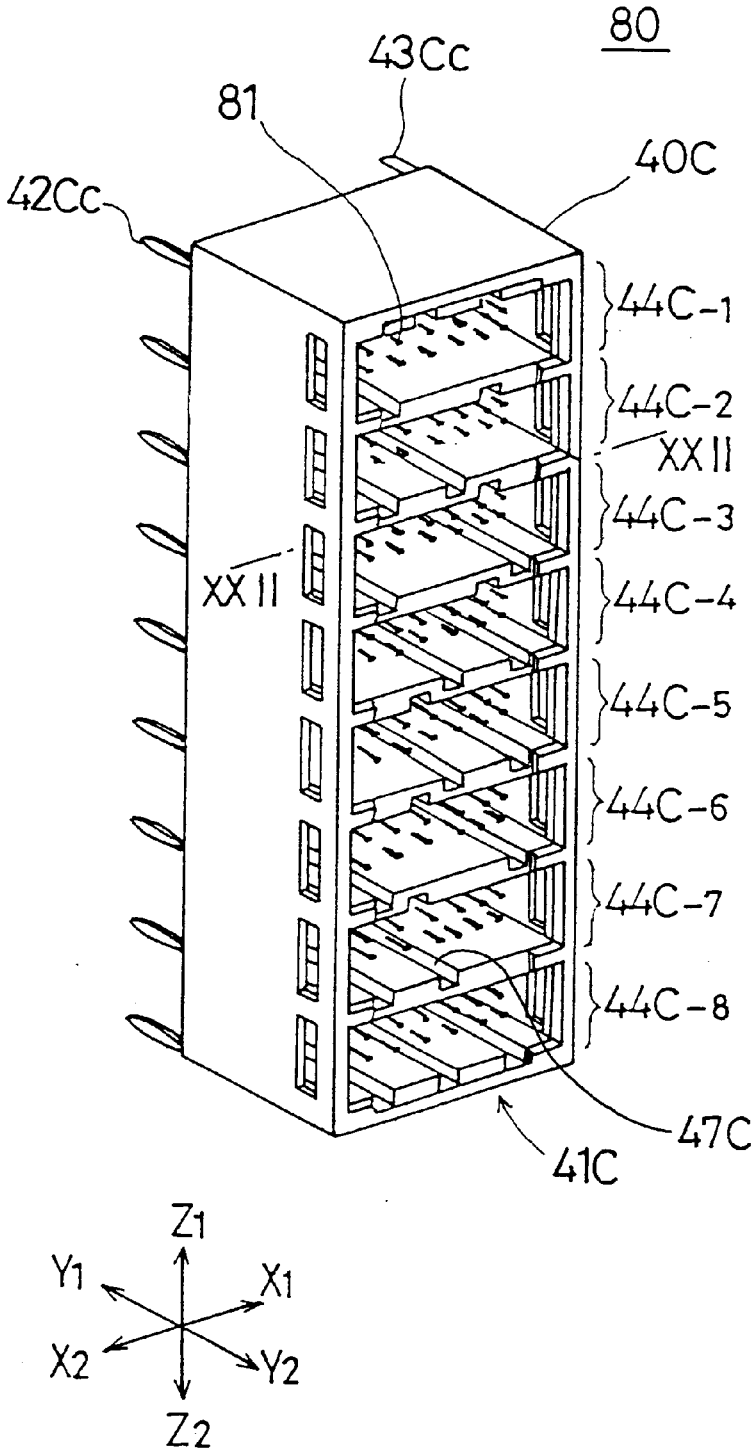
FIG. 20 is an oblique view of a connector according to a third embodiment of the present invention.
Figure 21:
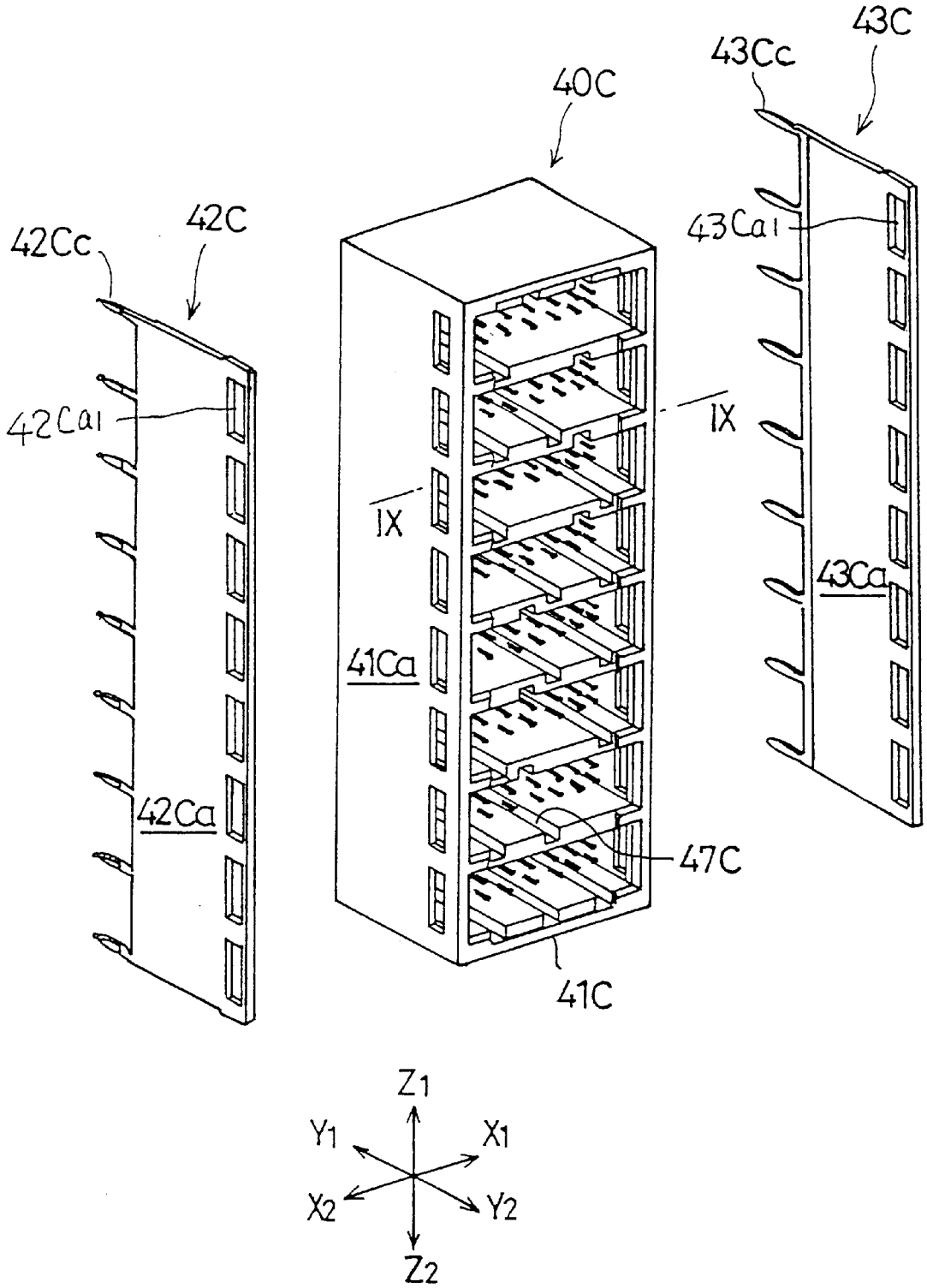
FIG. 21 is an exploded view of the connector of FIG. 20.

A description will now be given of a third embodiment of a connector 80 according to the present invention, with reference to FIGS. 20, 21 and 22. As shown in FIG. 20, the connector 80 is a structure in which a plurality of pins 81 are aligned and fixedly mounted to a shroud 40C.

The shroud 40C comprises a substantially rectangular shaped shroud body 41C made of electrically insulative plastic and metallic shield plates 42C and 43C insert molded along both sides of the shroud body in a lateral X1–X2 direction. A plurality of shroud compartments 44-1C through 44-8C are closely spaced in a vertical Z1–Z2 direction, and further, press-fit pins 42C*c* and 43C*c* project in rows from each of the shroud compartments. Instead of being insert molded, the shield plates 42C and 43C may be pressed into grooves on the shroud body 41C.

The shroud body 41C comprises rectangular longer side panels 41C*a* and 41C*b*, shorter side panels 41C*c* and 41C*d*, bottom panel 41C*e* and a plurality of partitions 41C*f*. The plurality of partitions 41C*f* are aligned so as to be evenly spaced in the vertical Z1–Z2 direction. Grooves 47C for preventing the mistaken or improper insertion of a plug are formed on the top and bottom surfaces of the partitions 41C*f*.

The shield plates 42C and 43C comprise bodies 42C*a* and 43C*a* having approximately the same size as the side panels 41C*a* and 41C*b* and a plurality of press-fit pins 42C*c* and 43C*c* projecting from the bodies 42C*a* and 43C*a* like the teeth of a comb at positions corresponding to the shroud compartments 44C-1 through 44C-8.

The plurality of pins 81 are pressed into a plurality of through-holes 41C*e*1 in the bottom panel 41C*e* and mounted thereto, and arranged in two rows at each shroud compartment 44C-1 through 44C-8. The pins 81 have portions 81*a* that project into the interior of the shroud compartments 44C-1 through 44C-8 and portions 81*b* that project from a bottom surface of the shroud 40C.

Figure 22:
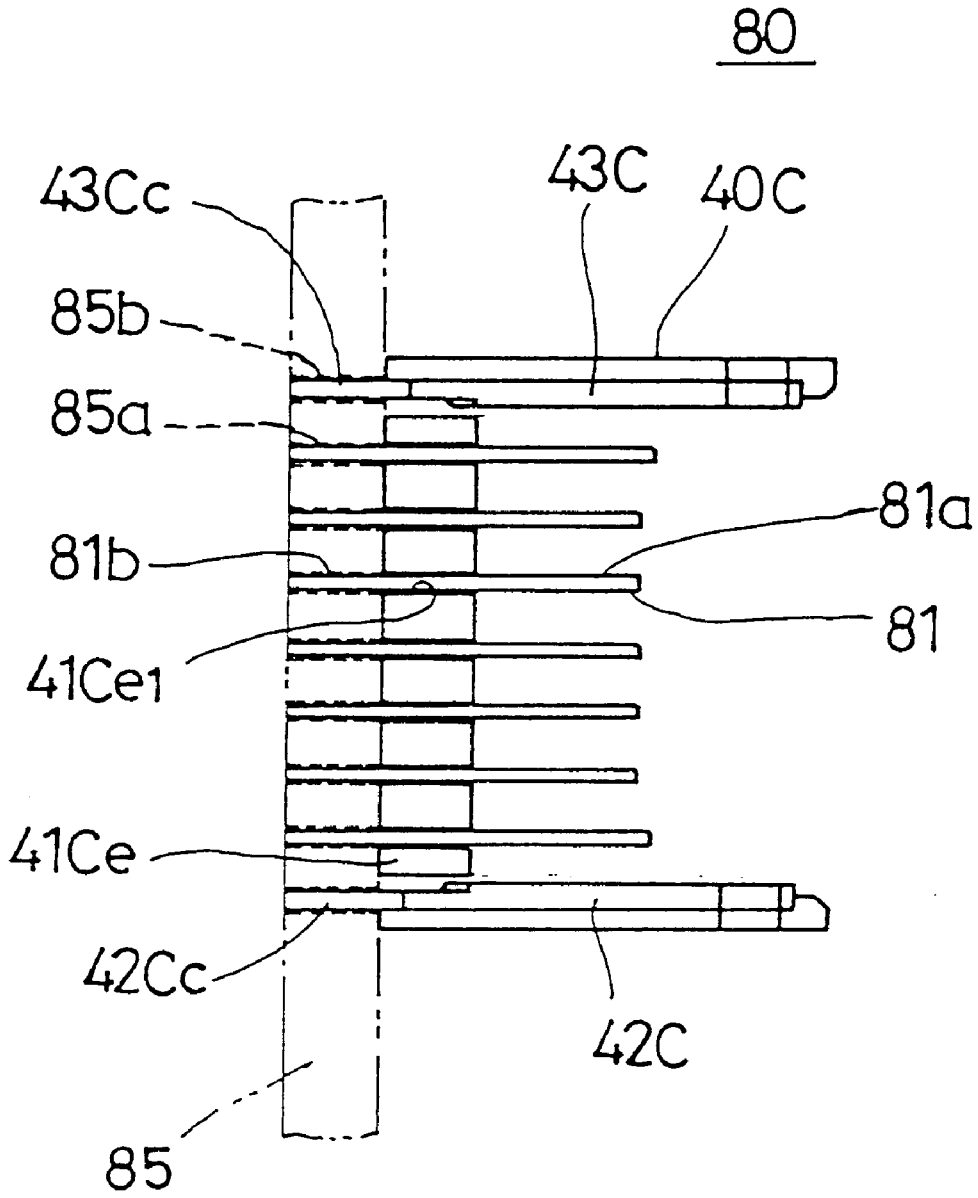
FIG. 22 is a cross-sectional view along a line XXII—XXII of the connector of FIG. 20.

As shown in FIG. 22, the pin portion 81*b* of the connector 80 is inserted into a through-hole 85*a* in a printed circuit board 85 and soldered thereto, with the press-fit pins 42C*c* and 43C*c* pressed into through-holes 85*b* in the printed circuit board 85 and mounted thereto. In this mounted state the plug 51 is connected.

Figure 23A:
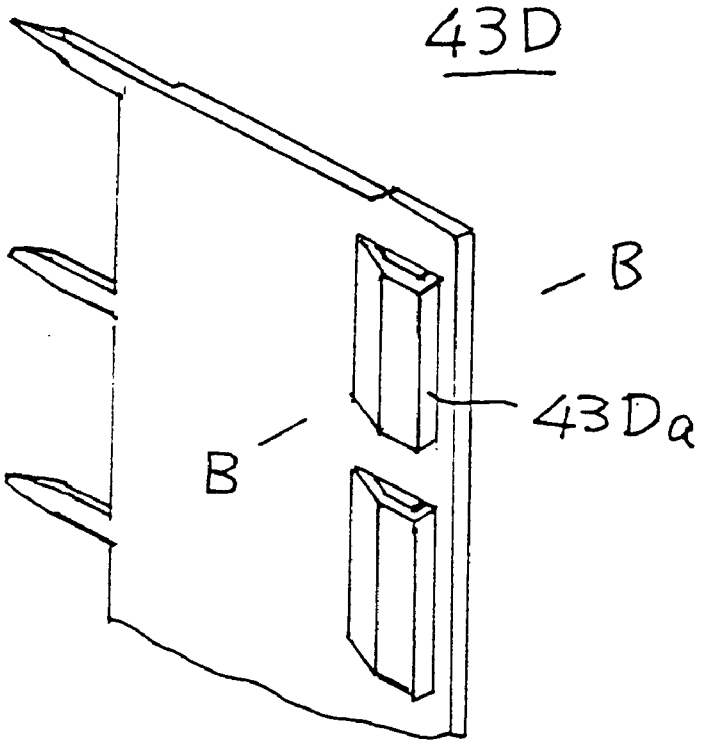
FIGS. 23A and 23B are partial side and cross-sectional views along a line B—B, respectively, of a variation of a shield plate.
Figure 23B:
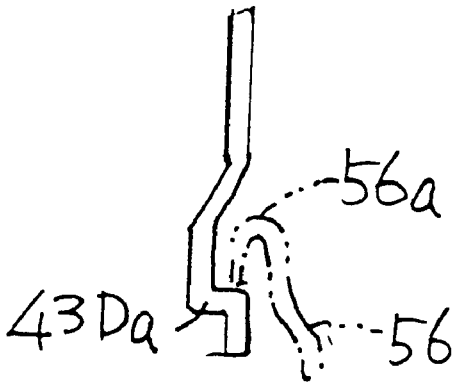

A description will now be given of a variation of a shield plate, with reference to FIGS. 23A and 23B.

The shield plate 43D shown in the diagrams has a lock step portion 43D*a* for a lock engaging part in place of the lock opening. As shown in FIG. 23B, this lock step portion 43D*a* engages the hook 56*a* of the latch member 56.

A description will now be given of a plug according to a fourth embodiment of the present invention, with reference to FIGS. 24A, 24B and 24C, which show steps in a process of unlocking such plug from the shroud.

Figures 24A, 24B, 24C:
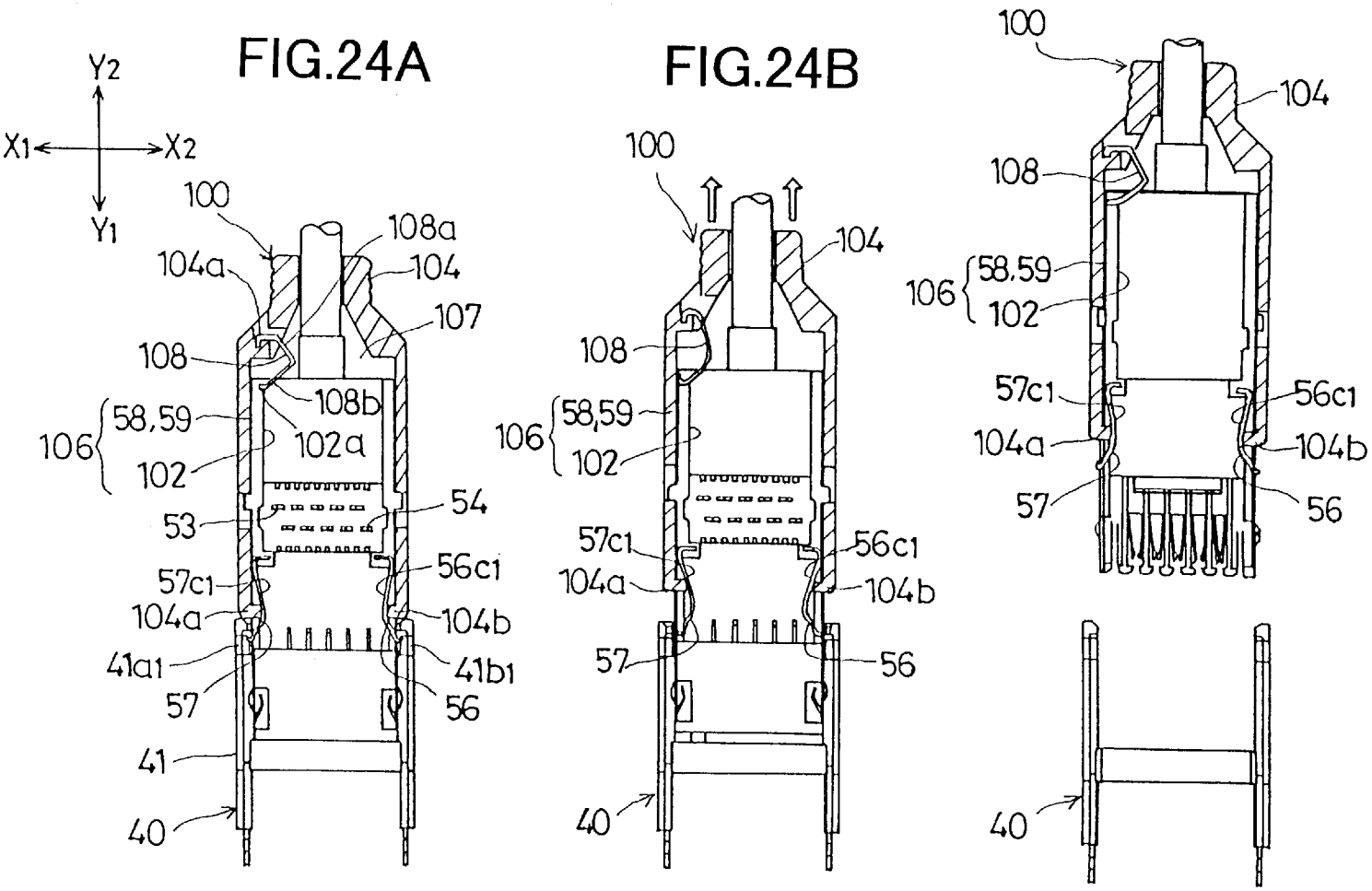
FIGS. 24A, 24B and 24C are diagrams showing steps in a process of unlocking a plug from the shroud according to a fourth embodiment of the present invention.

FIG. 24A shows a state in which a plug 100 is connected to and locked to the shroud 40, FIG. 24B shows a state just prior to unlocking of the plug 100 and FIG. 24C shows a state after the plug 100 has been unlocked. In FIGS. 24A, 24B and 24C, elements identical to the structural elements of plug 51 of the first embodiment described above are given the same reference numerals, and a description thereof omitted.

As shown in FIGS. 24A, 24B and 24C, the plug 100 is fitted to the shroud 40. The plug 100 comprises a housing 102 made of electrically insulative plastic and which includes first and second signal contacts 53 and 54, latch members 56 and 57 attached to both sides of the housing 102, lower and upper shield covers 58 and 59 covering the housing 102 and a lock release member 104 made of electrically insulative plastic and covering a portion of the lower and upper shield covers 58 and 59. The lock release member 104, the lower and upper shield covers 58 and 59 and the housing 102 are configured so as to be mutually displaceable within a predetermined range in the longitudinal Y1–Y2 direction. Hereinafter the housing 102 and the lower and upper shield covers 58 and 59 are referred to collectively as a connector assembly 106.

An internal space 107 is formed between a forward Y2 edge of the housing 102 and an inner surface of a forward Y2 edge of the lock release member 104. The plug 100 has a spring 108 disposed so as to be exposed to this internal space 107. The spring 108 is a substantially V-shaped leaf spring and is composed of an upper arm 108*a* and a lower arm 108*b*. A catch 102*a* is provided on the housing 102 and a catch 104*a* is provided on the lock release member 104, and therein the housing 102 and the lock release member 104 each differ from the housing 52 and lock release member 60, respectively, of the first embodiment described previously. The leaf spring 108 is further disposed so that a tip portion of the lower arm 108*b* is mounted on the catch 102*a* of the housing 102 and a tip portion of the upper arm is mounted on the catch 104*a* of the lock release member 104. The leaf spring 108 generates a force that pulls together the lock release member 104 and the connector assembly 106.

As shown in FIG. 24A, in a state in which the plug 100 is connected to the shroud 40, the lock release member 104 and the connector assembly 106 are maintained at predetermined positions by the leaf spring 108. In such a state, as shown in FIG. 24B, when the lock release member 104 is moved in the Y2 direction with respect to the connector assembly 106, projections 104*a* and 104*b* formed on a Y1 edge of the lock release member 104 press inward inclined portions 56*c*1 and 57*c*1 of latch members 56 and 57. Then, as the lock release member 104 continues to move in the Y2 direction, the latch members 56 and 57 are released from openings 41*a*1 and 41*b*1 formed on the shroud body 41 and, as shown in FIG. 24C, the locked connection between the plug 100 and the shroud 40 is released. Accordingly, as with the first embodiment described above, according to the present embodiment the connection of the plug 100 to the shroud 40 can be released simply and easily.

In the present embodiment, after the locked connection between the plug 100 and the shroud 40 is released, the lock release member 104 is moving in the Y2 direction with respect to the connector assembly 106, so the relative distance between the lock release member 104 and the connector assembly 106 increases and the leaf spring 108 elastically deforms in a direction in which a distance between the tip of the upper arm 108*a* and the tip of the lower arm 108*b* widens. At this time, a large pressing force is generated between the lock release member 104 and the connector assembly 106 so as to bring the two together. When such a force is generated the lock release member 104 and the connector assembly 106 are brought together.

As a result, according to the present embodiment, immediately after the locked connection between the plug 100 and the shroud 40 is released by moving the lock release member 104 in the Y2 direction, it is possible to securely return the lock release member 104 and the connector assembly 106 to original relative positions as shown in FIG. 24C without any additional manipulation of the lock release member 104.

By securely returning the lock release member 104 and the connector assembly 106 to original relative positions, the plug 100 and the shroud 40 can be securely connected to each other the next time the plug 100 is connected to the shroud 40 as well. Accordingly, according to the plug 100 of the present embodiment, it is possible to achieve a highly reliable connection to the shroud 40.

A description will now be given of a plug 110 according to a fifth embodiment of the present invention, with reference to FIG. 25 and FIGS. 26A, 26B and 26C.

Figure 25:
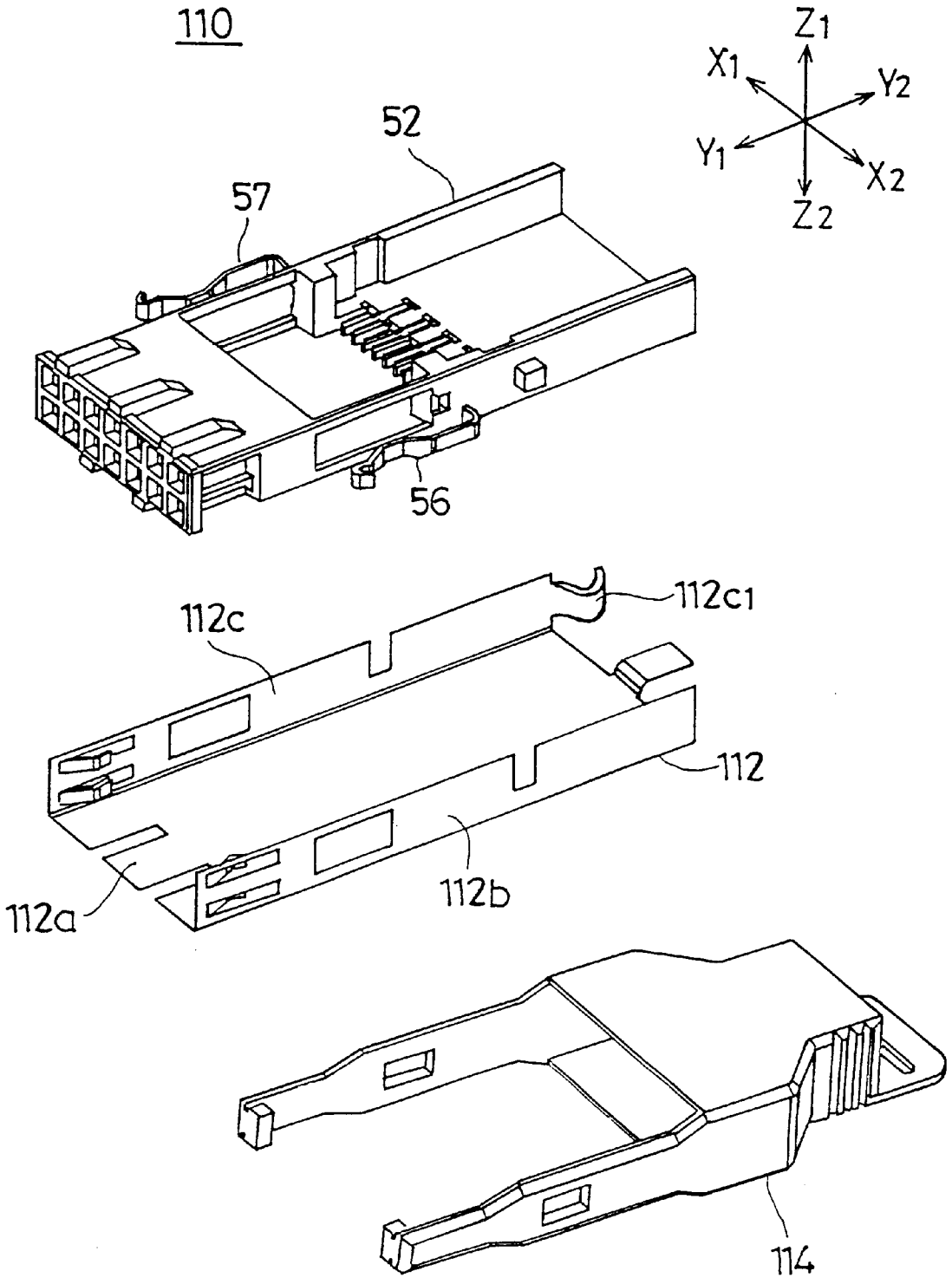
FIG. 25 is an exploded view of essential elements of a plug according to a fifth embodiment of the present invention.
Figure 26A:
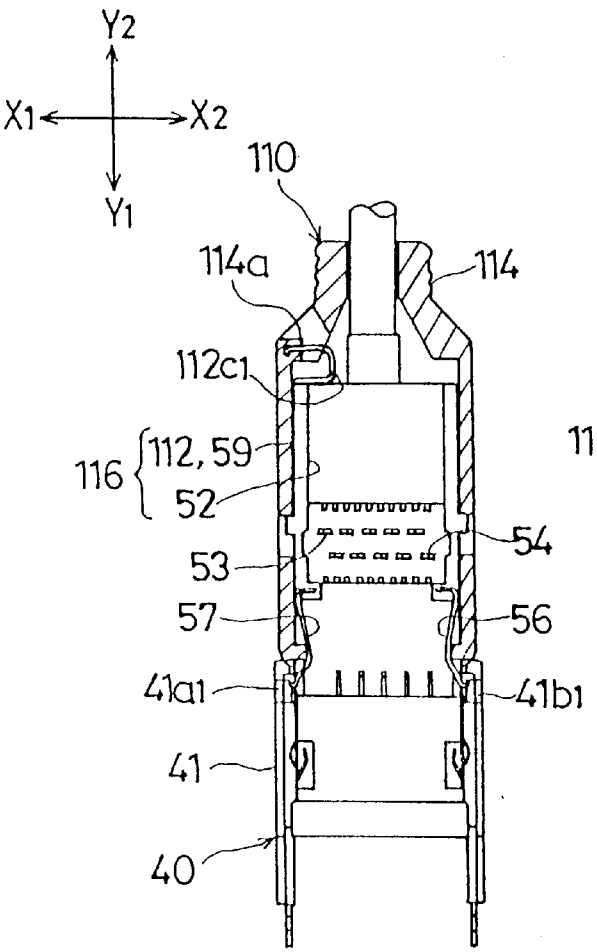
FIGS. 26A, 26B and 26C are diagrams showing steps in a process of unlocking the plug from the shroud shown in FIG. 25.
Figure 26B:
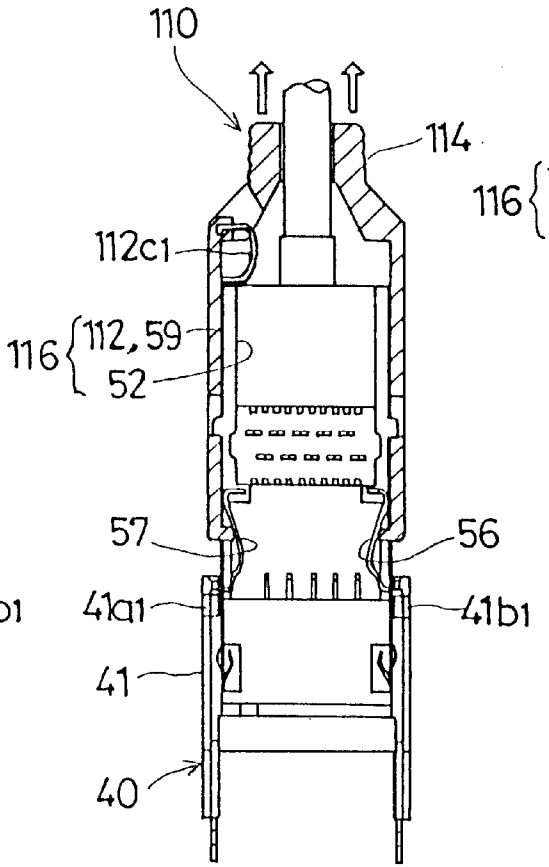
Figure 26C:
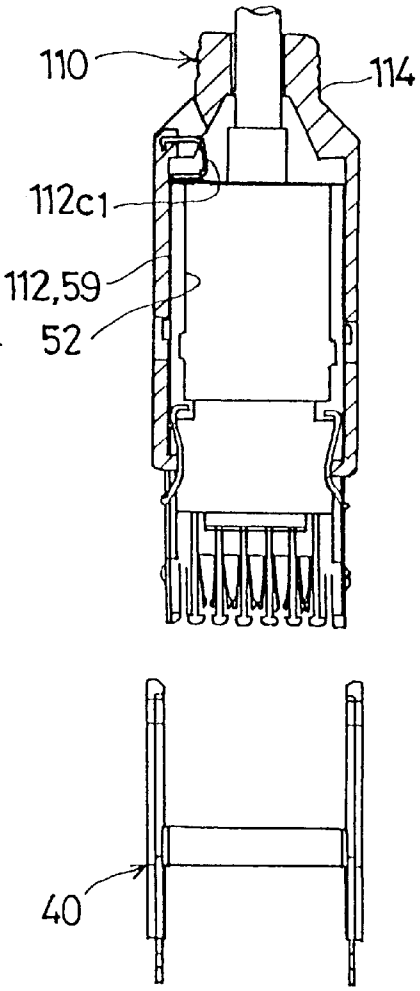

FIG. 25 is an exploded view of essential elements of a plug 110 according to this fifth embodiment of the present invention. FIGS. 26A, 26B and 26C are diagrams showing steps in a process of unlocking the plug 110 from the shroud 40.

FIG. 26A shows a state in which the plug 110 is connected to and locked to the shroud 40, FIG. 26B shows a state just prior to unlocking of the plug 110 and FIG. 26C shows a state after the plug 110 has been unlocked. In FIGS. 26A, 26B and 26C, elements identical to the structural elements of plug 51 of the first embodiment described above are given the same reference numerals, and a description thereof omitted.

As shown in FIG. 25 and FIGS. 26A, 26B and 26C, the plug 110 comprises a housing 52 made of electrically insulative plastic and which includes first and second signal contacts 53 and 54, latch members 56 and 57 attached to both sides of the housing 52, lower and upper shield covers 112 and 59 covering the housing 52 and a lock release member 114 made of electrically insulative plastic and covering a portion of the lower and upper shield covers 112 and 59. Hereinafter the housing 52 and the lower and upper shield covers 112 and 59 are referred to collectively as a connector assembly 116.

The lower shield cover 112 comprises a bottom panel 112*a* and side panels 112*b* and 112*c* extending upward from the from both X1- and X2-side edges of the bottom panel 112*a*. A leaf spring 112*c*1 is integrally formed on a Y2-side edge of the side panel 112*c* of the lower shield cover 112. A notch 114*a* for mounting a leaf spring 112*c*1 is provided on the lock release member 114. The leaf spring 112*c*1 is substantially V-shaped, and is disposed so that a forward edge of the leaf spring is affixed to the notch 114*a* of the lock release member 114 when the lock release member 114 and the connector assembly 116 are assembled. The leaf spring 112*c*1 generates a force that pulls the lock release member 114 and the connector assembly 116 together.

In the present embodiment, when the lock release member 114 is moved in the Y2 direction with respect to the connector assembly 116 as shown in FIG. 26B from a state in which the plug 110 is connected to the shroud 40 as shown in FIG. 26A, latch members 56 and 57 are released from openings 41*a*1 and 41*b*1 in the shroud body 41, thereby releasing the locked connection between the plug 110 and the shroud 40. Accordingly, according to the present embodiment the connection of the plug 110 to the shroud 40 can be released simply and easily.

As a result, according to the present embodiment, a large force can be generated by the leaf spring 112*c*1 between the lock release member 114 and the connector assembly 116 in a direction to pull the two together because the leaf spring 112*c*1 elastically deforms in a direction of an extension of an overall length of the leaf spring 112*c*1 immediately after the locked connection between the plug 110 and the shroud 40 is released.

As a result, according to the present embodiment, as with the fourth embodiment described above, it is possible to securely return the lock release member 114 and the connector assembly 116 to original relative positions as shown in FIG. 26C without any additional manipulation of the lock release member 114 by moving the lock release member 114 in the Y2 direction. Accordingly, as with the plug 100 of the fourth embodiment as described above, according to the plug 110 of the present embodiment it is possible to attain a highly reliable connection to the shroud 40.

Additionally, in the present embodiment, as described above, the leaf spring 112*c*1 is integrally formed on the lower shield cover 112. As a result, as with the fourth embodiment described above, according to the present embodiment it is possible to limit the number of component parts as compared to a case in which a leaf spring is provided as a separate member between the lock release member and the connector assembly, and, as a result, it is possible to improve the ease of assembly of the plug 110.

It should be noted that, although in the present embodiment the leaf spring 112*c*1 is integrally formed on the side panel 112*c* of the lower shield cover 112, the present invention is not limited to such an embodiment. Accordingly, a leaf spring may be integrally formed on the side panel 59*c* of the upper shield cover 59.

A description will now be given of a plug according to a sixth embodiment of the present invention, with reference to FIG. 27 and FIGS. 28A, 28B and 28C.

Figure 27:
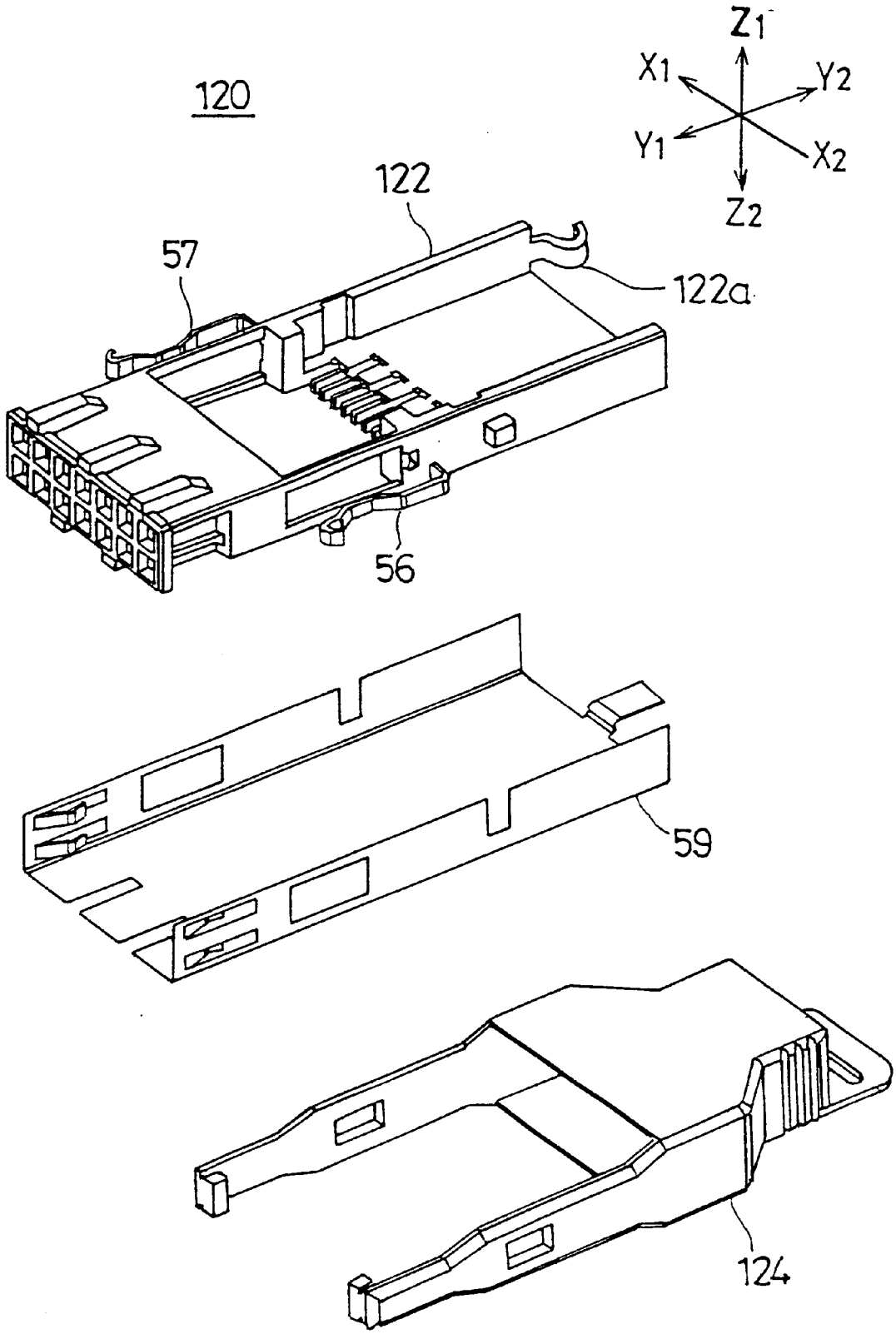
FIG. 27 is an exploded view of essential elements of a plug according to a sixth embodiment of the present invention.
Figure 28C:
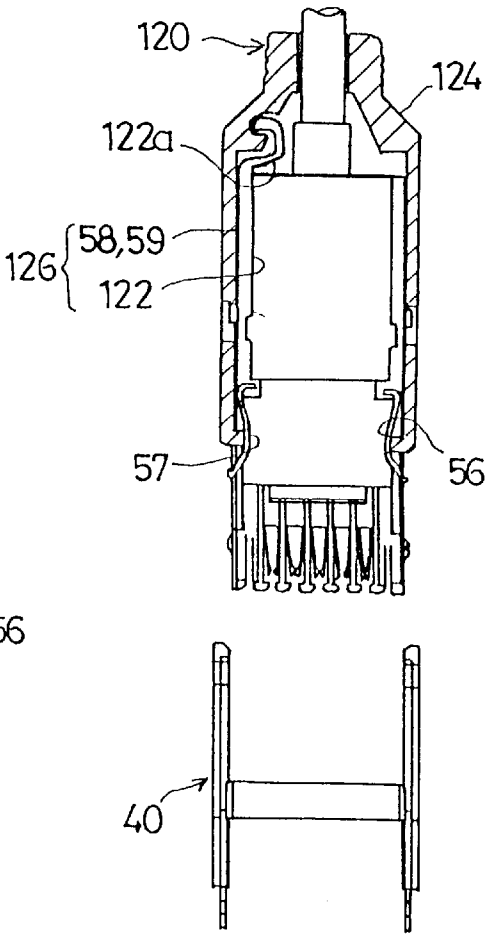
FIGS. 28A, 28B and 28C are diagrams showing steps in a process of unlocking the plug from the shroud shown in FIG. 27.
Figure 28B:
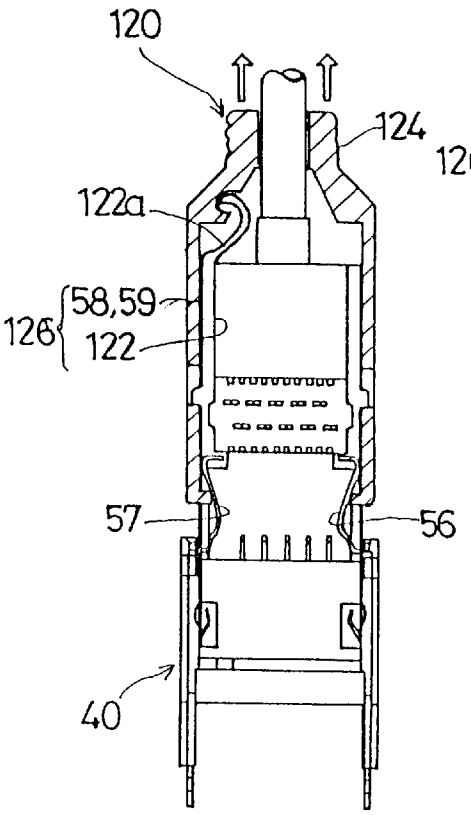
Figure 28A:
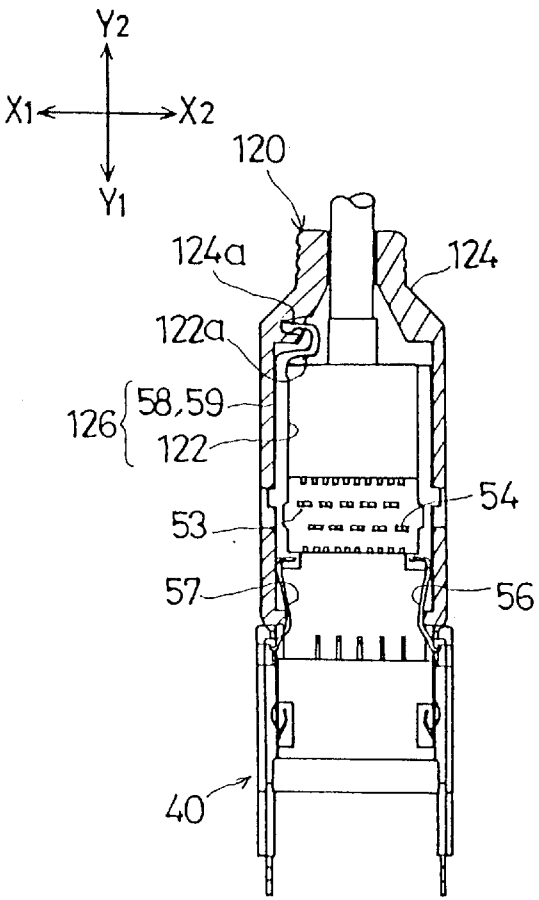

FIG. 27 is an exploded view of essential elements of a plug 120 according to a sixth embodiment of the present invention. Additionally, FIGS. 28A, 28B and 28C are diagrams showing steps in a process of unlocking the plug 120 from the shroud 40. FIG. 28A shows a state in which the plug 120 is connected to and locked to the shroud 40, FIG. 28B shows a state just prior to unlocking of the plug 120 and FIG. 28C shows a state after the plug 120 has been unlocked. In FIGS. 28A, 28B and 28C, elements identical to the structural elements of plug 51 of the first embodiment described above are given the same reference numerals, and a description thereof omitted.

As shown in FIG. 27 and FIGS. 28A, 28B and 28C, the plug 120 comprises a housing 122 made of electrically insulative plastic and which includes first and second signal contacts 53 and 54, latch members 56 and 57 attached to both sides of the housing 122, lower and upper shield covers 58 and 59 covering the housing 52 and a lock release member 124 made of electrically insulative plastic and covering a portion of the lower and upper shield covers 58 and 59. Hereinafter the housing 122 and the lower and upper shield covers 58 and 59 are referred to collectively as a connector assembly 126.

The housing 122 has a structure such that a leaf spring 122*a* is integrally formed on a Y1 edge of the housing 52 of the first embodiment as described above. A notch portion 124*a* for mounting the leaf spring 122*a* is provided on the lock release member 124. The leaf spring 122*a* is substantially V-shaped, and is disposed so that a forward edge thereof is affixed to the notch portion 124*a* of the lock release member 124 when the lock release member 124 and the connector assembly 126 are assembled. The leaf spring 122*a* generates a force that pulls the lock release member 114 and the connector assembly 116 together.

In the present embodiment as well, when the lock release member 124 is moved in the Y2 direction with respect to the connector assembly 126 as shown in FIG. 28B from a state in which the plug 120 is connected to the shroud 40 as shown in FIG. 28A, the locked connection between the plug 120 and the shroud 40 is released. Accordingly, according to the present embodiment the connection of the plug 120 to the shroud 40 can be released simply and easily.

In the present embodiment, a large force can be generated between the lock release member 124 and the connector assembly 126 in a direction to pull the two together by the leaf spring 122*a* formed on the housing 122 because the leaf spring 122*a* elastically deforms in a direction of an extension of an overall length of the leaf spring 122*a* immediately after the locked connection between the plug 120 and the shroud 40 is released.

As a result, according to the present embodiment, as with the fourth embodiment described above, it is possible to securely return the lock release member 124 and the connector assembly 126 to original relative positions as shown in FIG. 28C without any additional manipulation of the lock release member 124 by moving the lock release member 124 in the Y2 direction. Accordingly, as with the plug 100 of the fourth embodiment as described above, according to the plug 120 of the present embodiment it is possible to attain a highly reliable connection to the shroud 40.

Additionally, in the present embodiment as described above, the leaf spring 122*a* is integrally formed on the housing 122. As a result, as with the fifth embodiment described above, according to the present embodiment it is possible to limit the number of component parts as compared to a case in which a leaf spring is provided as a separate member between the lock release member and the connector assembly, and, as a result, it is possible to improve the ease of assembly of the plug 120.

A description will now be given of a plug according to a seventh embodiment of the present invention, with reference to FIGS. 29A, 29B and 29C.

Figure 29A:
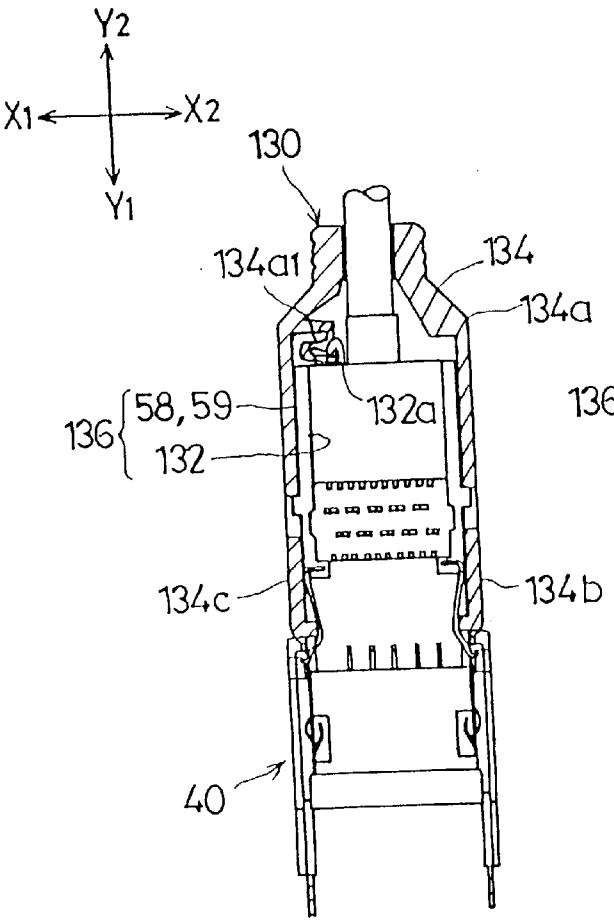
FIGS. 29A, 29B and 29C are diagrams showing steps in a process of unlocking a plug from the shroud according to a seventh embodiment of the present invention.
Figure 29B:
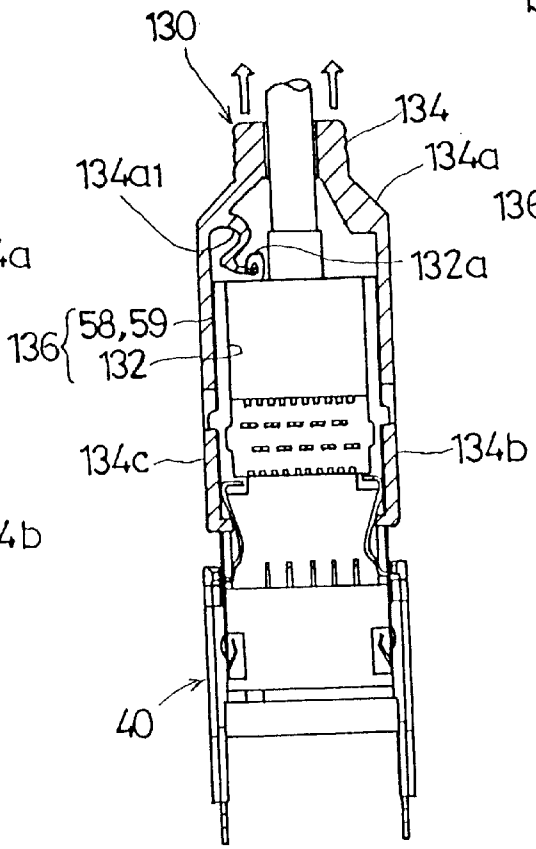
Figure 29C:
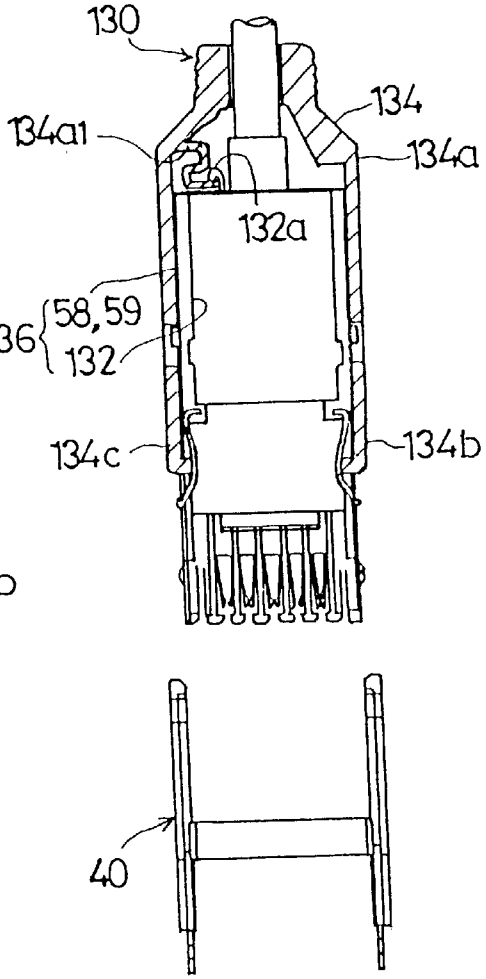

FIGS. 29A, 29B and 29C are diagrams showing steps in a process of unlocking a plug 130 from the shroud 40. FIG. 29A shows a state in which the plug 130 is connected to and locked to the shroud 40, FIG. 29B shows a state just prior to unlocking of the plug 130 and FIG. 29C shows a state after the plug 130 has been unlocked.

The plug 130 of the present embodiment is achieved by using a housing 132 in place of the housing 52 of the plug 51 of the first embodiment described above and using a lock release member 134 instead of the lock release member 60. Hereinafter, the housing 132 and the lower and upper shield covers 58 and 59 are referred to collectively as a connector assembly 136. In FIGS. 29A, 29B and 29C, elements identical to the structural elements of plug 51 of the first embodiment described above are given the same reference numerals, and a description thereof omitted.

As shown in FIGS. 29A, 29B and 29C, the lock release member 134 comprises a box 134*a*, and arms 134*b* and 134*c* extending from the lateral X1–X2 sides of the box 134*a* in the Y1 direction. An inverted S-shaped spring 134*a*1 is integrally formed on an interior surface edge on a Y2 side of the box 124*a*. A latch 132*a* for mounting the spring 134*a*1 is mounted on a Y2 side edge of the housing 132. The spring 134*a*1 is disposed so that a forward tip of the spring 134*a*1 is mounted on the latch 132*a* of the housing 132 when the lock release member 134 and connector assembly 136 are assembled. The spring 134*a*1 generates a force that pulls the lock release member 134 and the connector assembly 136 together.

In the present embodiment, when the lock release member 134 is moved in the Y2 direction with respect to the connector assembly 136 as shown in FIG. 29B from a state in which the plug 130 is connected to the shroud 40 as shown in FIG. 29A, the locked connection between the plug 130 and the shroud 40 is released. In the present embodiment, a large force can be generated between the lock release member 134 and the connector assembly 136 in a direction to pull the two together by the spring 134*a*1 formed on the housing 132 because the spring 134*a*1 elastically deforms in a direction of an extension of an overall length of the spring 134*a*1 immediately after the locked connection between the plug 130 and the shroud 40 is released.

As a result, according to the present embodiment as with the fourth embodiment described above, it is possible to securely return the lock release member 134 and the connector assembly 136 to original relative positions as shown in FIG. 28C without any additional manipulation of the lock release member 134 by moving the lock release member 134 in the Y2 direction. Accordingly, as with the plug 100 of the fourth embodiment as described above, according to the plug 130 of the present embodiment it is possible to attain a highly reliable connection to the shroud 40.

Additionally, in the present embodiment as described above, the spring 134*a*1 is integrally formed on the housing 134. As a result, as with the fifth embodiment described above, according to the present embodiment it is possible to limit the number of component parts as compared to a case in which a leaf spring is provided as a separate member between the lock release member and the connector assembly, and, as a result, it is possible to improve the ease of assembly of the plug 120.

It should be noted that in embodiments 4, 5, 6 and 7 as described above the spring that generates the force that pulls the housing and the lock release member together is provided only on an X1 side edge. However, the spring may also be provided only on an X2 side edge or on both X1 and X2 edges.

A description will now be given of a plug according to an eighth embodiment of the present invention, with reference to FIGS. 30A, 30B and 30C as well as FIGS. 31A and 31B.

Figure 30C:
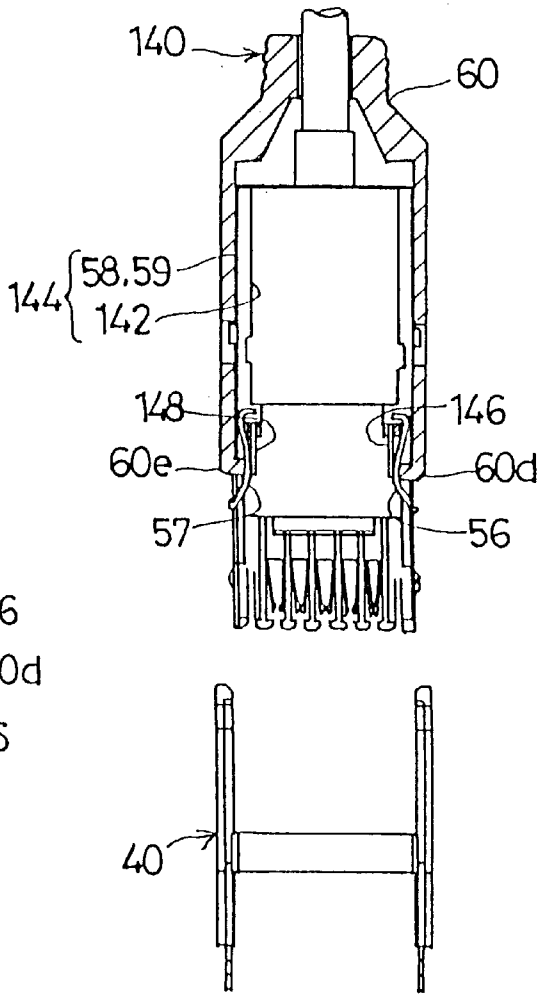
FIGS. 30A, 30B and 30C are diagrams showing steps in a process of unlocking a plug from the shroud according to an eighth embodiment of the present invention.
Figure 30B:
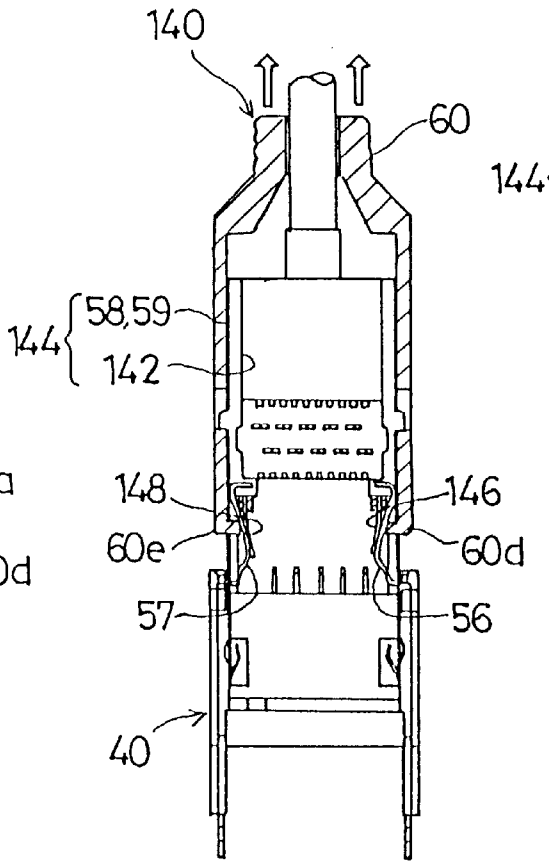
Figure 30A:
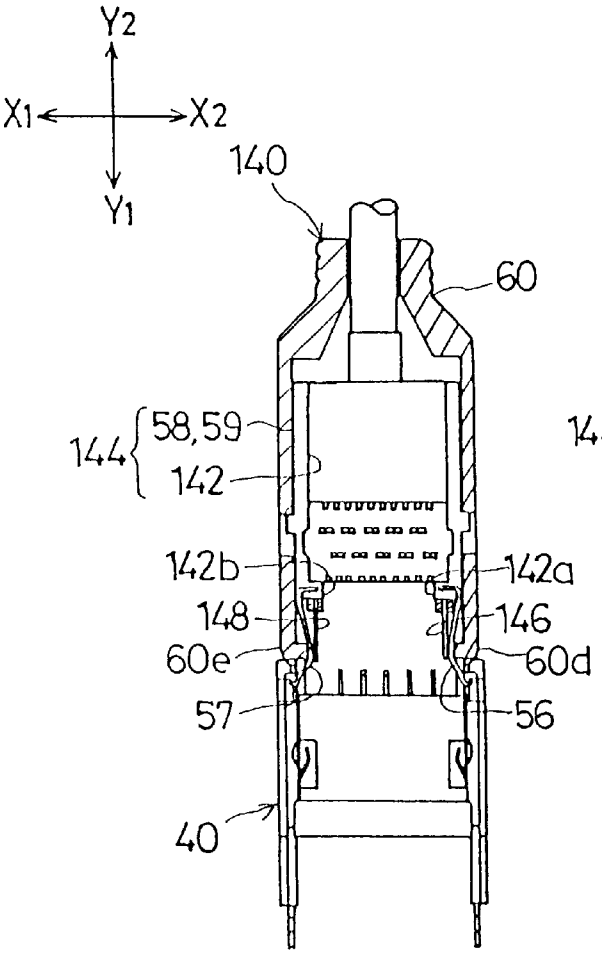
Figure 31B:
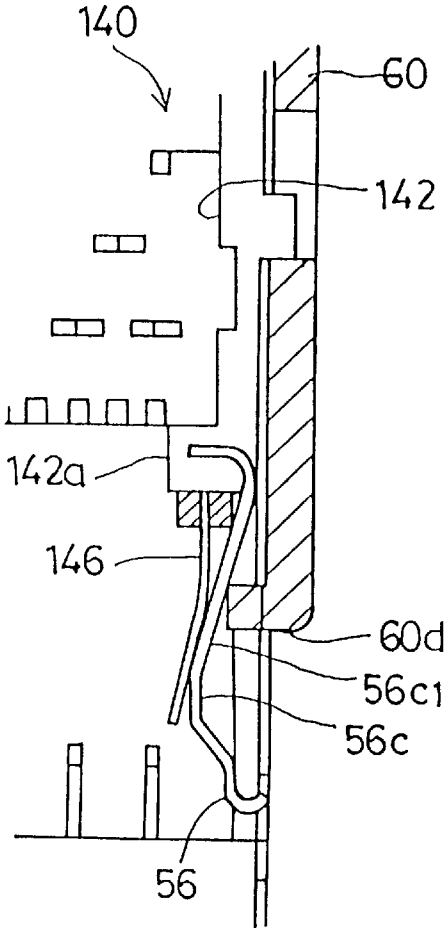
FIGS. 31A and 31B are exploded views of essential elements of the plug shown in FIG. 30.
Figure 31A:
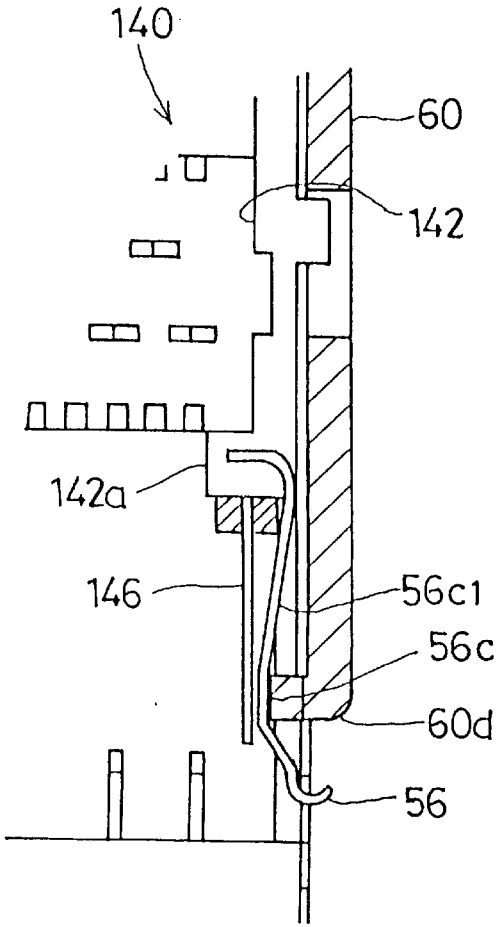

FIGS. 30A, 30B and 30C are diagrams showing steps in a process of unlocking a plug 140 from the shroud 40. FIGS. 31A and 31B are exploded views of essential elements of the plug 140. FIG. 30A shows a state in which the plug 140 is connected to and locked to the shroud 40, FIG. 30B shows a state just prior to unlocking of the plug 140 and FIG. 30C shows a state after the plug 140 has been unlocked.

The plug 140 of the present embodiment is achieved by using a housing 142 in place of the housing 52 of the plug 51 of the first embodiment described above. Hereinafter, the housing 142 and the lower and upper shield covers 58 and 59 are referred to collectively as a connector assembly 144. In FIGS. 30A, 30B and 30C and in FIGS. 31A and 31B, elements identical to the structural elements of plug 51 of the first embodiment described above are given the same reference numerals, and a description thereof omitted.

As shown in FIGS. 30A, 30B and 30C, the housing 142 has projections 142*a* and 142*b* formed on central parts of interior side surfaces for mounting latch members 56 and 57. Leaf springs 146 and 148 extending in the Y1 direction are fixedly mounted on the projections 142*a* and 142*b*. As shown in FIG. 31A, the leaf springs 146 and 148 are normally disposed so that tip portions thereof just contact base intermediate portions 56*c* and 57*c* of latch members 56 and 57, or, as shown in FIG. 31B, the tips are pressed laterally in the X1–X2 direction by base intermediate portions 56*c* and 57*c* of latch members 56 and 57 when the locked connection between the plug 140 and the shroud 40 is released. In such a composition, the leaf springs 146 and 148 generate a pressing force to press the latch members 56 and 57 outward by elastically deforming during the process of release of the locked connection described above.

In the present embodiment, when the lock release member 60 is moved in the Y2 direction with respect to the connector assembly 144 as shown in FIG. 30B from a state in which the plug 140 is connected to the shroud 40 as shown in FIG. 30A, projections 60*d* and 60*e* press inclined portions 56*c*1 and 57*c*1 of the latch members 56 and 57 inward. Then, as the lock release member 60 continues to move in the Y2 direction the latch members 56 and 57 are released from openings 41*a*1 and 41*b*1 in the shroud body 41 and the locked connection between the plug 140 and the shroud 40 is released as shown in FIG. 30C.

After the above-described locked connection is released a large pressing force is generated outwardly by the leaf springs 146 and 148 against the latch members 56 and 57. That is, according to the leaf springs 146 and 148 of the present invention, after the above-described locked connection is released, a force to supplement the spring force of the latch members 56 and 57 themselves can be generated. When such force is so generated the inclined portions 56*c*1 and 57*c*1 of latch members 56 and 57 press the projections 60*d* and 60*e* of the latch release member 60 back in the Y1 direction.

As a result, according to the present embodiment, immediately after the locked connection between the plug 140 and the shroud 40 is released by moving the lock release member 60 in the Y2 direction, it is possible to securely return the lock release member 60 and the connector assembly 144 to original relative positions as shown in FIG. 30C without any additional manipulation of the lock release member 134. Accordingly, according to the plug 140 of the present embodiment, it is possible to attain a highly reliable connection to the shroud 40.

The above description is provided in order to enable any person skilled in the art to make and use the invention and sets forth the best mode contemplated by the inventors of carrying out their invention.

The present invention is not limited to the specifically disclosed embodiments and variations, and modifications may be made without departing from the scope of the present invention.

The present application is based on Japanese priority application no. 11-191028, filed on Jul. 5, 1999, the entire contents of which are hereby incorporated by reference.

What is claimed is:

1. A plug, comprising:

a housing made of electrically insulative material and comprising signal contacts;

a metallic shield cover enclosing the housing;

a latch member provided at both side surfaces of the housing; and a lock release member provided on an outer side of the shield cover, the lock release member comprising:

a pull tab on a same side from which a cable is extended; and a projection disposed opposite the latch member, the projection releasing a locked state by using the latch member when the lock release member is pulled, the projection having a groove, the groove being guided by an edge of an opening of the shield cover.

2. The plug as claimed in claim 1, wherein an edge of the latch member in a direction in which the lock release member is pulled is mounted on a side surface of the housing, a sloped portion being provided in a vicinity of the mounted area, such that an action of releasing the lock is performed by elastic deformation, the projection pulling the sloped portion when the lock release member is pulled, the sloped portion returning the projection to an original position by using a spring force of the latch member when the lock release member is released.

3. The plug as claimed in claim 1, wherein a slit having a tag is provided on the pull tab.

4. The plug as claimed in claim 1, wherein the signal contacts are arranged in parallel rows and comprise a first bent signal contact and a second straight signal contact, the first signal contact and the second signal contact having identical lengths.

5. The plug as claimed in claim 1, the housing having a key that prevents improper insertion of the plug.

6. The plug as claimed in claim 2, further comprising an auxiliary spring generating a force to augment the spring force of the latch member.

7. An apparatus, comprising:

a shield cover enclosing a housing, the housing having two side surfaces;

a latch member on the side surfaces of the housing; and a lock release member on an outer side of the shield cover, the lock release member comprising a projection disposed opposite the latch member, the projection releasing a locked state by using the latch member when the lock release member is pulled, the projection having a groove guided by the shield cover.

* * * * *